US009534403B2

(12) United States Patent
Biec

(10) Patent No.: US 9,534,403 B2
(45) Date of Patent: Jan. 3, 2017

(54) WEDGE SYSTEM

(71) Applicant: Edmund Biec, Mississauga (CA)

(72) Inventor: Edmund Biec, Mississauga (CA)

( * ) Notice: Subject to any disclaimer, the term of this patent is extended or adjusted under 35 U.S.C. 154(b) by 0 days.

(21) Appl. No.: 14/720,054

(22) Filed: May 22, 2015

(65) Prior Publication Data

US 2015/0308130 A1 Oct. 29, 2015

Related U.S. Application Data

(63) Continuation-in-part of application No. PCT/CA2015/050323, filed on Apr. 17, 2015.

(60) Provisional application No. 61/984,379, filed on Apr. 25, 2014.

(51) Int. Cl.
*E04F 21/00* (2006.01)

(52) U.S. Cl.
CPC ..... *E04F 21/0092* (2013.01)

(58) Field of Classification Search
CPC ..... E04F 21/1877; E04F 21/0092
See application file for complete search history.

(56) References Cited

U.S. PATENT DOCUMENTS

D269,495 S * 6/1983 Finn ..... D8/47
4,625,489 A * 12/1986 Bogle ..... F16B 2/14 254/104
4,688,363 A * 8/1987 Sweeney ..... E04B 1/4185 52/407.4
4,908,952 A * 3/1990 Joos ..... E04F 13/14 33/526
D538,150 S * 3/2007 Burns ..... D8/402
7,784,751 B1 * 8/2010 Bellows ..... A47B 91/00 248/188.2
7,992,354 B2 * 8/2011 Doda, Jr. ..... E04F 13/0892 52/127.7
8,429,879 B1 * 4/2013 Hoffman ..... E04F 21/0092 52/747.11
8,671,628 B2 * 3/2014 Sighinolfi ..... E04F 21/0092 33/527
8,800,246 B2 * 8/2014 Gorton ..... E04F 21/22 52/747.11

(Continued)

FOREIGN PATENT DOCUMENTS

JP 2012167428 A 9/2012
WO 2011121476 A1 10/2011

*Primary Examiner* — Elizabeth A Quast
(74) *Attorney, Agent, or Firm* — McCarter & English, LLP

(57) ABSTRACT

A wedge system for creating a tiled surface includes wedge receivers and wedges. Each wedge receiver has a planar element and a hook extending from the planar element in perpendicular relation. The hook is disposed as a tile spacer between a pair of tiles. The planar element is disposed beneath the tiles. Each wedge has a clamping surface and a ribbed gripping surface orientated in angular relation to one another to meet in an edge with the ribs comprising an arcuate arrangement. In use, the wedge extends through the aperture of the wedge receiver such that the clamping surface is positioned in abutting relation against the tiles and the hook is resiliently deformed to provide for a clamped engagement of the tiles between the clamping surface and the planar element, to provide for substantially coplanar relation of the tiles. Further, the gripping surface grips the wedge receiver to resist withdrawal of the wedge and maintain the clamped engagement until the mortar has cured.

4 Claims, 42 Drawing Sheets

(56) References Cited

U.S. PATENT DOCUMENTS

| | | | | |
|---|---|---|---|---|
| 8,887,475 | B2 * | 11/2014 | Ghelfi | E04F 21/0092 52/749.11 |
| 2008/0236094 | A1 | 10/2008 | Doda | |
| 2013/0055675 | A1 | 3/2013 | Sighinolfi | |
| 2014/0033640 | A1 * | 2/2014 | Gorton | E04F 21/22 52/747.11 |
| 2014/0116001 | A1 * | 5/2014 | Ghelfi | E04F 21/0092 52/749.11 |

* cited by examiner

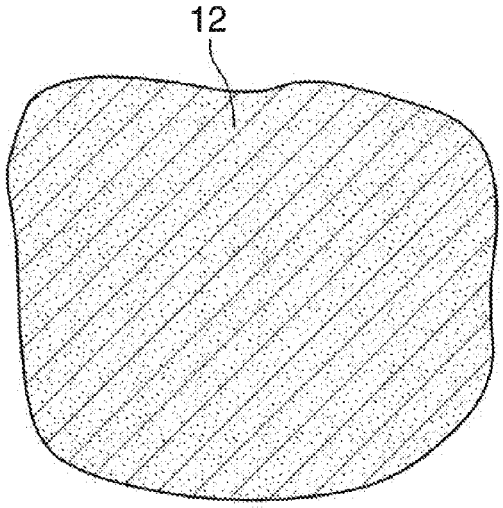
FIG.2
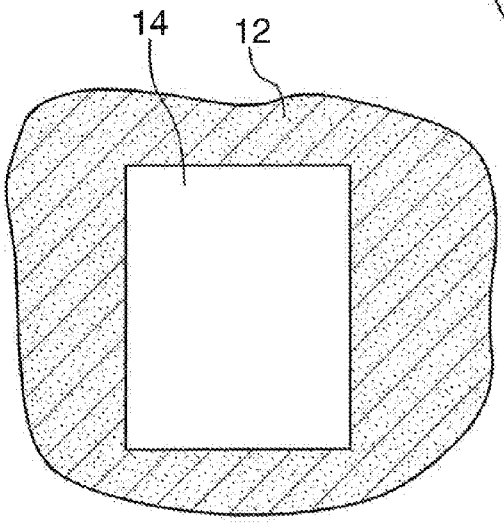
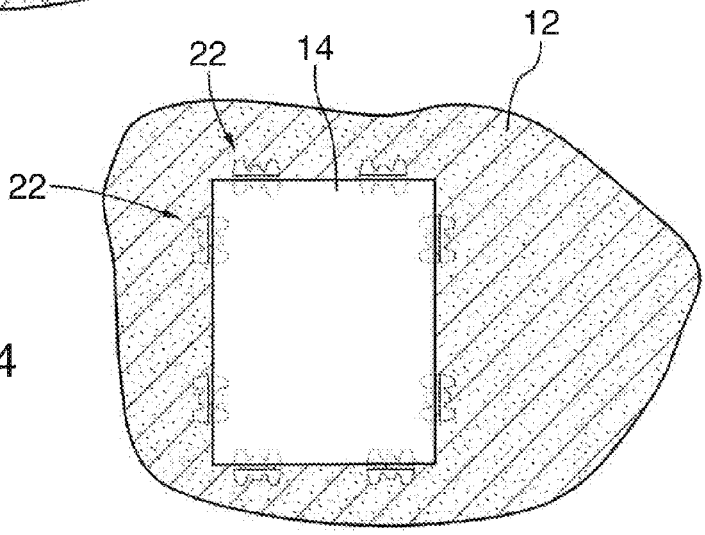
FIG.4

WEDGE SYSTEM

CROSS-REFERENCE TO RELATED APPLICATIONS

This patent application is a continuation-in-part of currently-pending International Patent Application No. PCT/CA2015/050323 designating the United States, filed Apr. 17, 2015, and claims priority to U.S. Provisional Patent Application No. 61/984,379, filed Apr. 25, 2014, both of which are hereby incorporated by reference in their entireties as part of the present disclosure.

FIELD OF THE INVENTION

The invention relates to the field of tile.

BACKGROUND OF THE INVENTION

It is known to use wedge systems to facilitate the installation of tile.

A known wedge system involves wedges and wedge receivers. Each wedge has a planar surface and a ribbed surface orientated in angular relation to one another to meet in an edge. Each wedge receiver has a planar element and a hook element extending from the planar element in substantially perpendicular relation. The hook element has an aperture defined therein. In use, the tiles are laid in a generally conventional manner. The hook elements are used to space apart the tiles, with the planar elements embedded or laid upon the thin set. Each wedge element is threaded through a respective aperture and pushed forward in the direction of the edge such that the tiles are captured between the planar elements of the wedge receivers and the planar surfaces of the wedges; this causes the tiles to align with one another. The ribbed surface of the wedge receiver provides for a tight and reliable grip. After the mortar has set, the wedges are removed, the hook elements are separated from the planar elements by a mallet and the tiles are grouted in a conventional manner.

SUMMARY OF THE INVENTION

Forming one aspect of the invention is an improved wedge system of the type used with tiles and mortar for creating a tiled surface having an array of the tiles arranged in substantially coplanar side-by-side evenly spaced relation.

The wedge system includes wedge receivers and wedges.

Each wedge receiver has a planar element and a resilient hook element extending from the planar element in substantially perpendicular relation, the hook element having an aperture defined therein and being frangibly connected to the planar element.

Each hook element, in use, is disposed in the manner of a tile spacer between a pair of adjacent tiles in an array of the tiles laid in the mortar, thereby to provide for said substantially even side-by-side spacing of the tiles.

Each planar element, in use, is disposed beneath the pair of adjacent tiles.

Each wedge has a clamping surface and a ribbed gripping surface orientated in angular relation to one another to meet in an edge.

Each wedge, in use, extends through the aperture of a respective receiver such that:

the planar surface of the wedge is positioned in abutting relation against the pair of adjacent tiles;

the hook element is resiliently deformed, to provide for a clamped engagement of the pair of adjacent tiles between the planar surface of the wedge and the planar element, thereby to provide for said substantially coplanar relation;

the gripping surface grips the respective wedge receiver, to resist withdrawal of the wedge from the aperture and maintain the clamped engagement until the mortar has cured.

The improvement comprises an arcuate arrangement of the ribs.

According to another aspect of the invention, the ribs can be shaped such that, in use, when the wedge is inserted through the aperture of a hook element and the hook element is resiliently deformed, an edge of the hook element that presents towards the ribbed surface of the wedge is use, is itself arcuate and nests in a valley defined between adjacent ribs.

BRIEF DESCRIPTION OF THE DRAWINGS

FIG. 2 is plan view of a mortar bed;

FIG. 3 is a view of the structure of FIG. 2 to which a tile has been secured;

FIG. 4 is a view of the structure of FIG. 3 in use with a plurality of the wedge receivers;

FIG. 11A is a front left perspective view of a wedge receiver; FIG. 11B is a front bottom left perspective view, FIG. 11C is a front elevational view, FIG. 11D is a rear elevational view, FIG. 11E is a top plan view, FIG. 11F is a bottom plan view, 11G is a left elevational view, and FIG. 11H is a right elevational view, respectively, of the wedge receiver of FIG. 11A;

FIG. 12A is a front left perspective view of a wedge receiver; FIG. 12B is a front bottom left perspective view, FIG. 12C is a front elevational view, FIG. 12D is a rear elevational view, FIG. 12E is a top plan view, FIG. 12F is a bottom plan view, 12G is a left elevational view, and FIG. 12H is a right elevational view, respectively, of the wedge receiver of FIG. 12A;

FIG. 13A is a front left perspective view of a wedge receiver; FIG. 13B is a front bottom left perspective view, FIG. 13C is a front elevational view, FIG. 13D is a rear elevational view, FIG. 13E is a top plan view, FIG. 13F is a bottom plan view, 13G is a left elevational view, and FIG. 13H is a right elevational view, respectively, of the wedge receiver of FIG. 13A;

FIG. 14A is a front left perspective view of a wedge receiver; FIG. 14B is a front bottom left perspective view, FIG. 14C is a front elevational view, FIG. 14D is a rear elevational view, FIG. 14E is a top plan view, FIG. 14F is a bottom plan view, 14G is a left elevational view, and FIG. 14H is a right elevational view, respectively, of the wedge receiver of FIG. 14A;

FIG. 15A is a front left perspective view of a wedge receiver; FIG. 15B is a front bottom left perspective view, FIG. 15C is a front elevational view, FIG. 15D is a rear elevational view, FIG. 15E is a top plan view, FIG. 15F is a bottom plan view, 15G is a left elevational view, and FIG. 15H is a right elevational view, respectively, of the wedge receiver of FIG. 15A;

FIG. 16A is a front left perspective view of a wedge receiver; FIG. 16B is a front bottom left perspective view, FIG. 16C is a front elevational view, FIG. 16D is a rear elevational view, FIG. 16E is a top plan view, FIG. 16F is a bottom plan view, 16G is a left elevational view, and FIG. 16H is a right elevational view, respectively, of the wedge receiver of FIG. 16A;

FIG. 17A is a front left perspective view of a wedge receiver; FIG. 17B is a front bottom left perspective view, FIG. 17C is a front elevational view, FIG. 17D is a rear elevational view, FIG. 17E is a top plan view, FIG. 17F is a bottom plan view, 17G is a left elevational view, and FIG. 17H is a right elevational view, respectively, of the wedge receiver of FIG. 17A;

FIG. 18A is a front left perspective view of a wedge receiver; FIG. 18B is a front bottom left perspective view, FIG. 18C is a front elevational view, FIG. 18D is a rear elevational view, FIG. 18E is a top plan view, FIG. 18F is a bottom plan view, 18G is a left elevational view, and FIG. 18H is a right elevational view, respectively, of the wedge receiver of FIG. 18A;

FIG. 19A is a front left perspective view of a wedge receiver; FIG. 19B is a front bottom left perspective view, FIG. 19C is a front elevational view, FIG. 19D is a rear elevational view, FIG. 19E is a top plan view, FIG. 19F is a bottom plan view, 19G is a left elevational view, and FIG. 19H is a right elevational view, respectively, of the wedge receiver of FIG. 19A;

DETAILED DESCRIPTION OF EMBODIMENTS OF THE INVENTION

Figure 1:
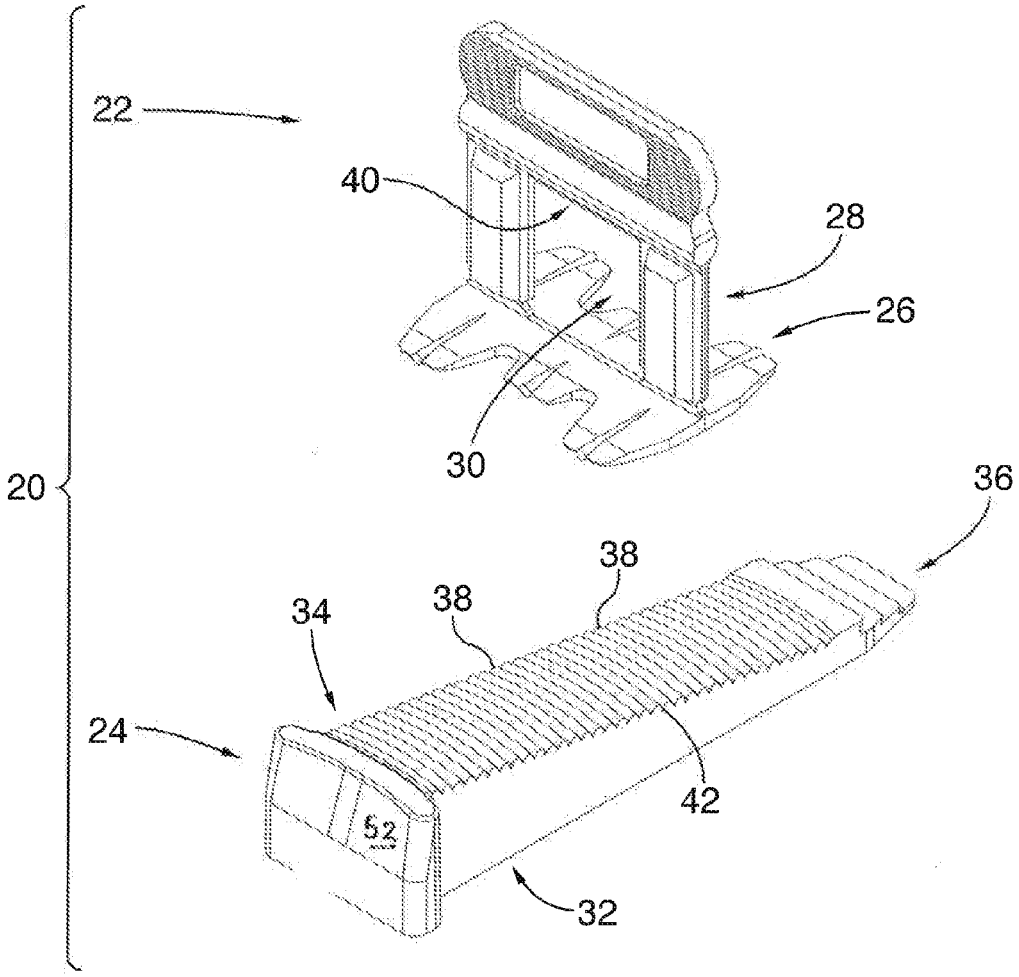
FIG. 1 is a perspective view of the components of a wedge system according to an exemplary embodiment of the invention.

Reference is now made to FIG. 1 which shows the components of a wedge system 20 according to an exemplary embodiment of the invention.

The wedge system 20 will be understood to be of the general type used with tiles and mortar for creating a tiled surface having an array of the tiles arranged in substantially coplanar side-by-side evenly spaced relation and including wedge receivers 22 and wedges 24.

Each wedge receiver has a planar element 26 and a resilient hook element 28 extending from the planar element in substantially perpendicular relation, the hook element having an aperture 30 defined therein and being frangibly connected to the planar element.

Figure 5:
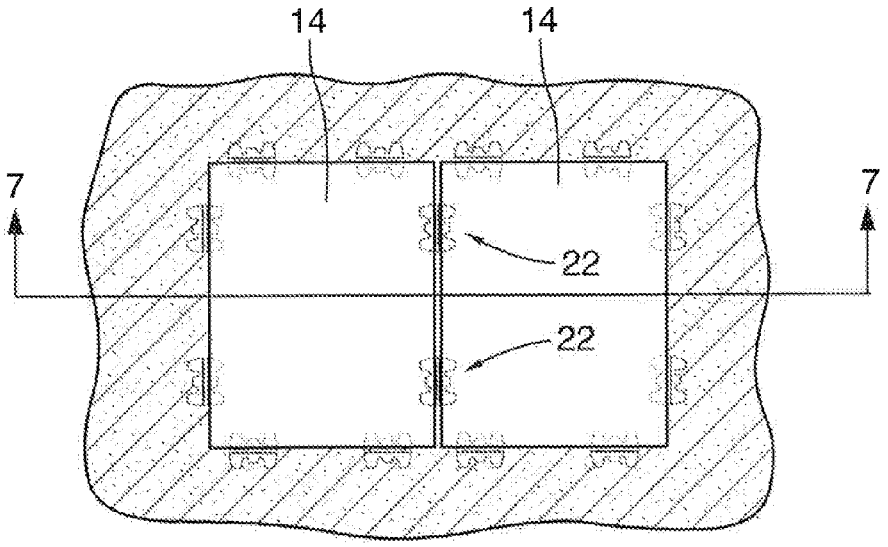
FIG. 5 is a view of the structure of FIG. 4, to which another tile and further wedge receivers have been added.
Figure 7:
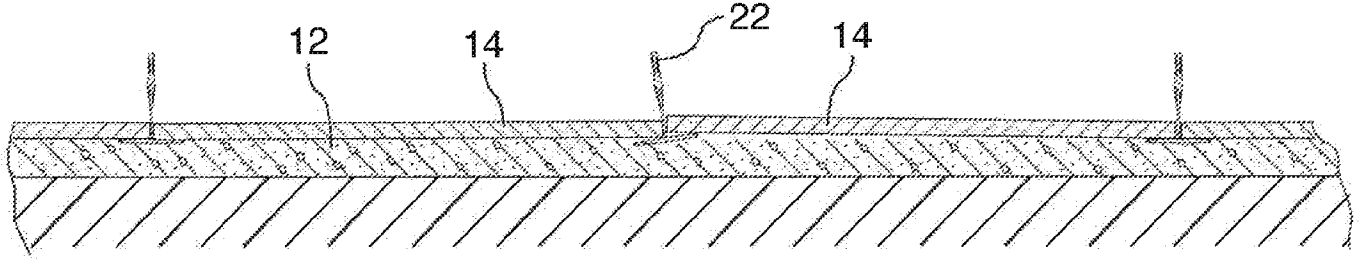
FIG. 7 is a view along section 7-7 of FIG. 5.

Each hook element 28, in use, is disposed in the manner of a tile spacer between a pair of adjacent tiles 14 in an array of the tiles laid in a mortar bed 12, thereby to provide for substantially even side-by-side spacing of the tiles. The planar element 26 from which said each hook element 28 extends, in use, is disposed beneath the pair of adjacent tiles 14, all as shown in FIGS. 5 and 7.

Each wedge has a clamping surface 32 and a gripping surface 34 orientated in angular relation to one another to meet in an edge 36. At the end of the wedge opposite edge 36 is a forcing surface 52 that is disposed at an angle to the clamping surface 32.

Figure 6:
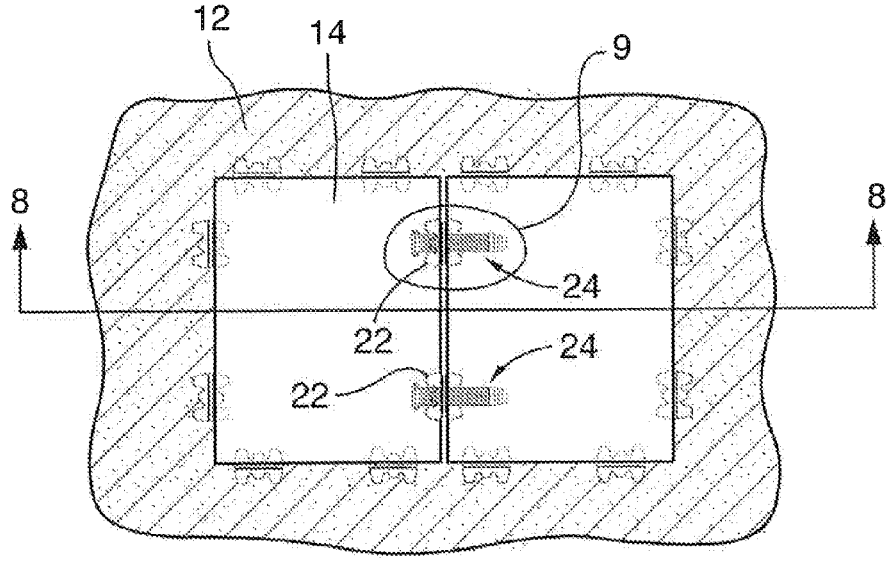
FIG. 6 is a view of the structure of FIG. 5 in use with a pair of the wedges.
Figure 8:
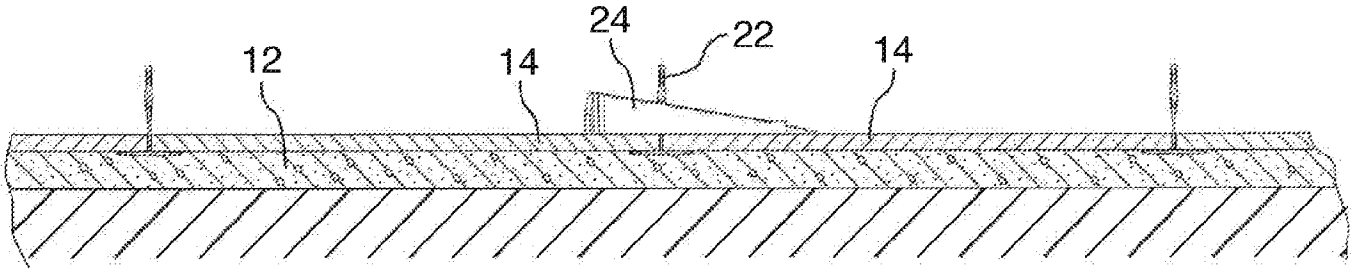
FIG. 8 is a view along section 8-8 of FIG. 6.
Figure 9:
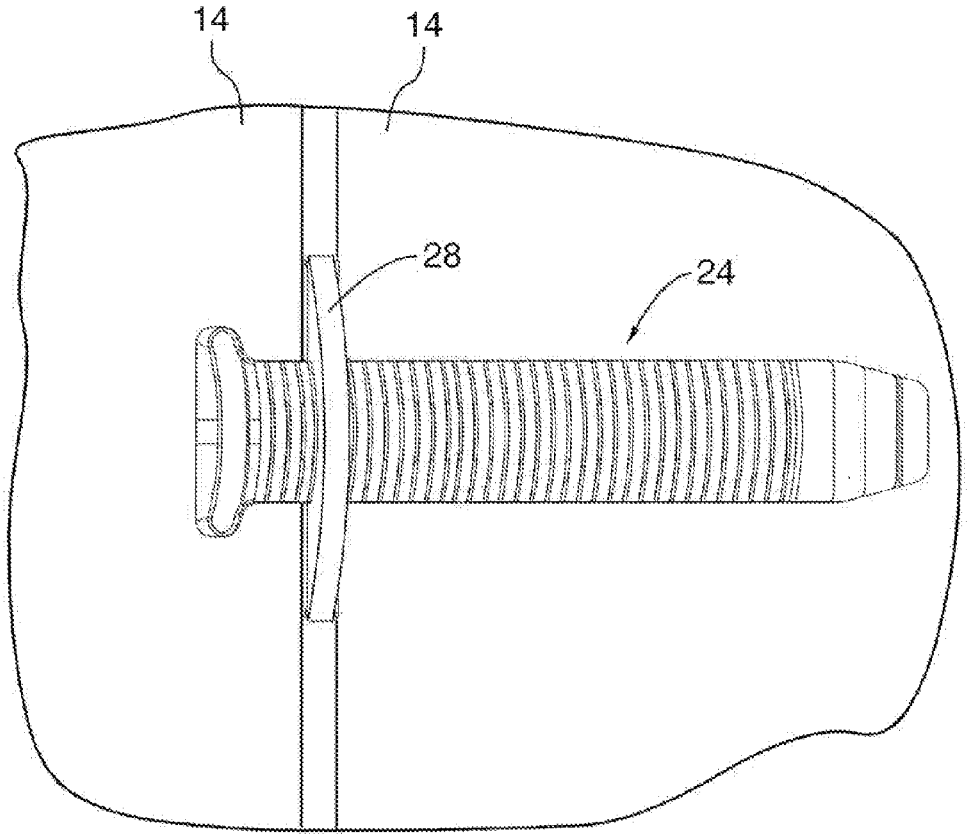
FIG. 9 is an enlarged view of encircled structure 9 of FIG. 6.
Figure 10:
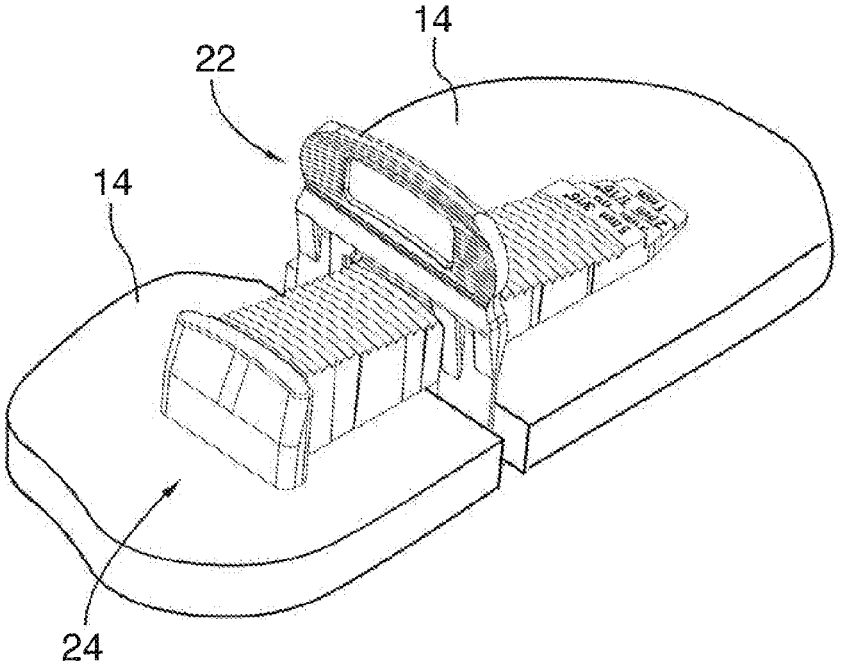
FIG. 10 is a perspective view of the structure of FIG. 9.
Figure 11A:
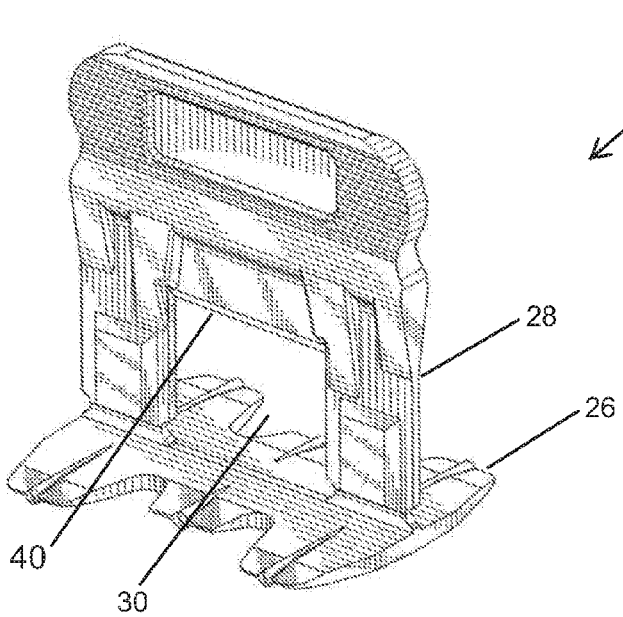
FIGS. 11A-H are views of a wedge receiver according to another embodiment.
Figure 11B:
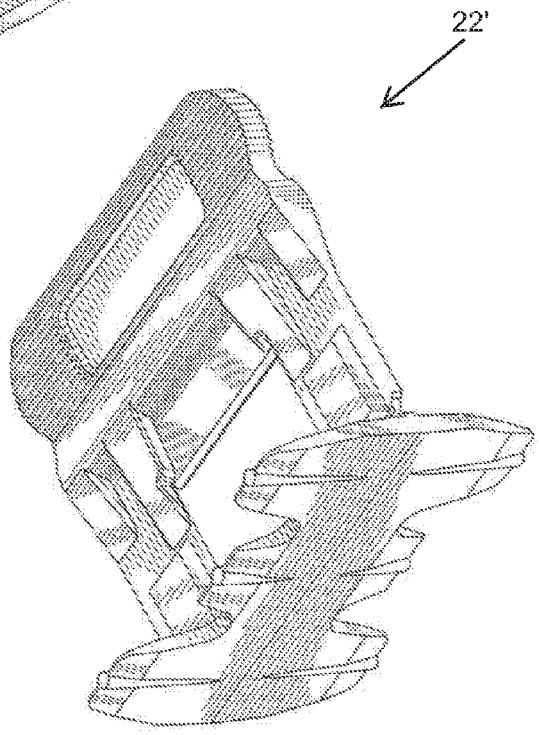
Figure 11C:
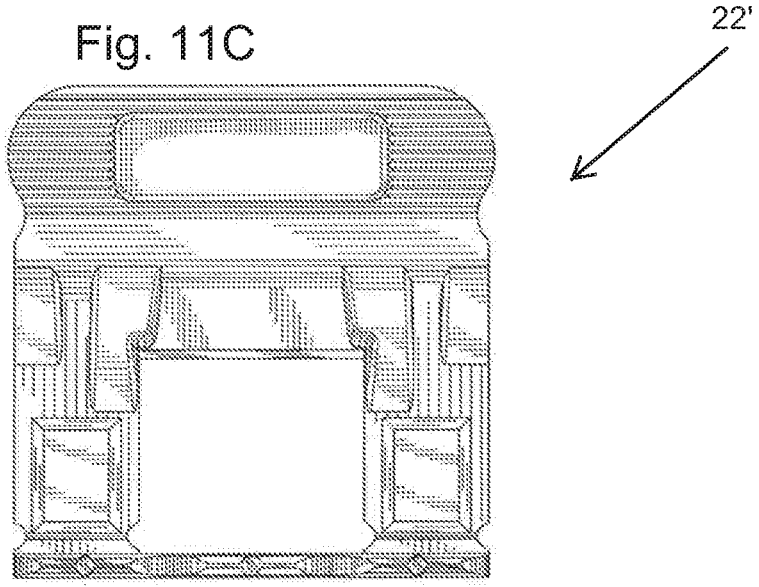
Figure 11D:
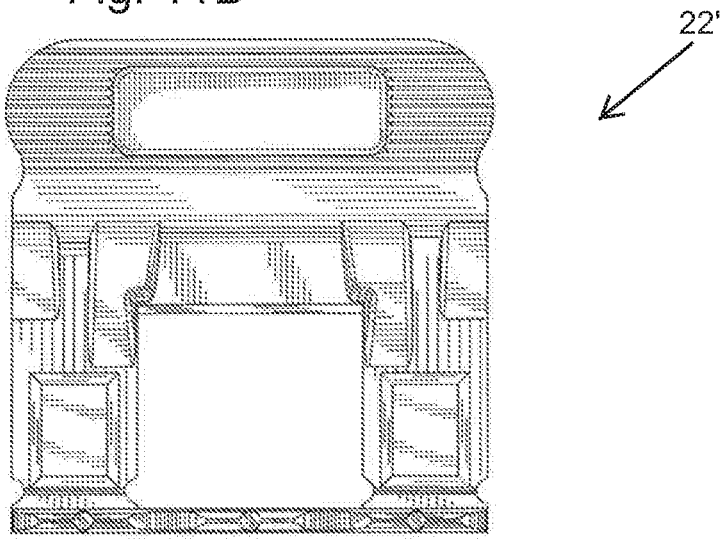
Figure 11E:
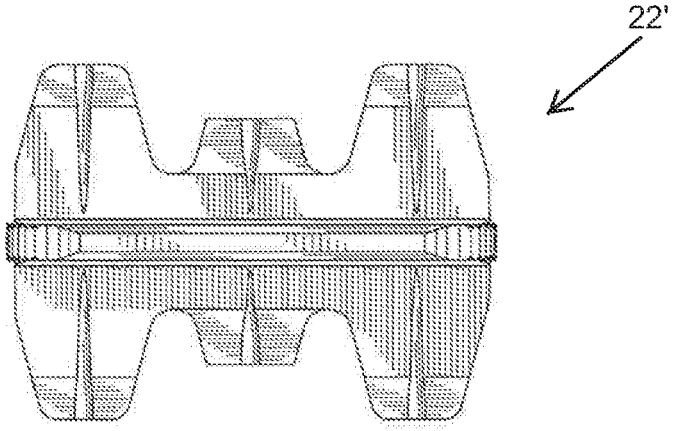
Figure 11F:
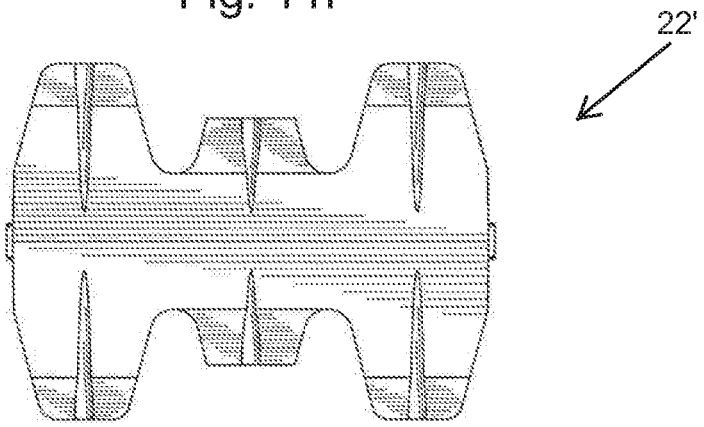
Figure 11G:
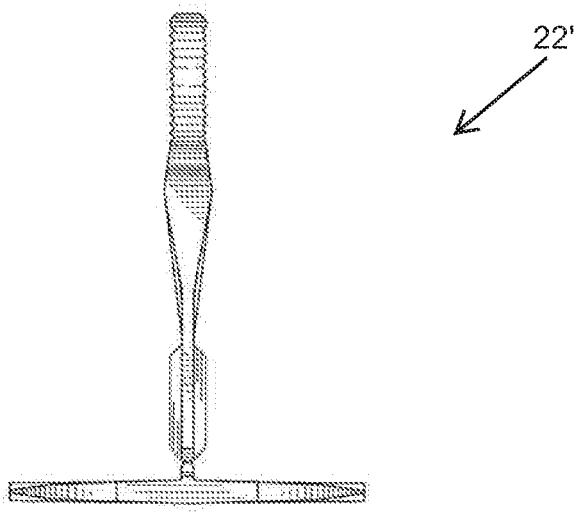
Figure 11H:
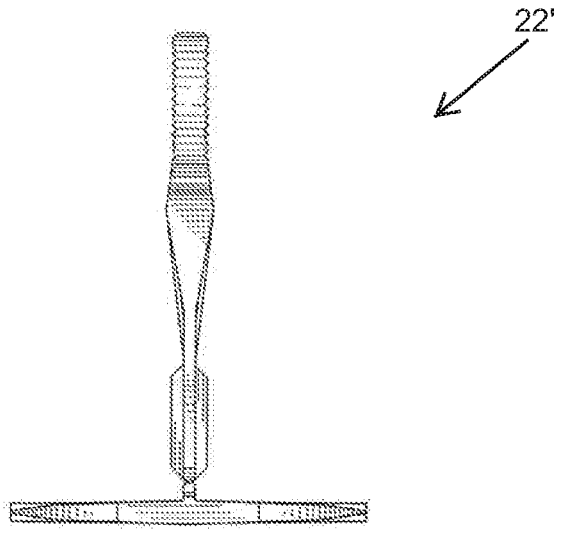
Figure 12A:
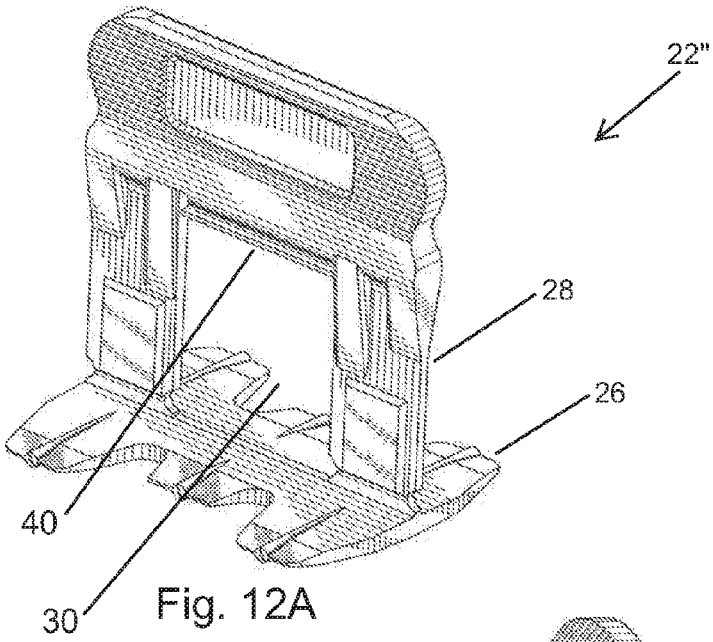
FIGS. 12A-H are views of a wedge receiver according to another embodiment.
Figure 12B:
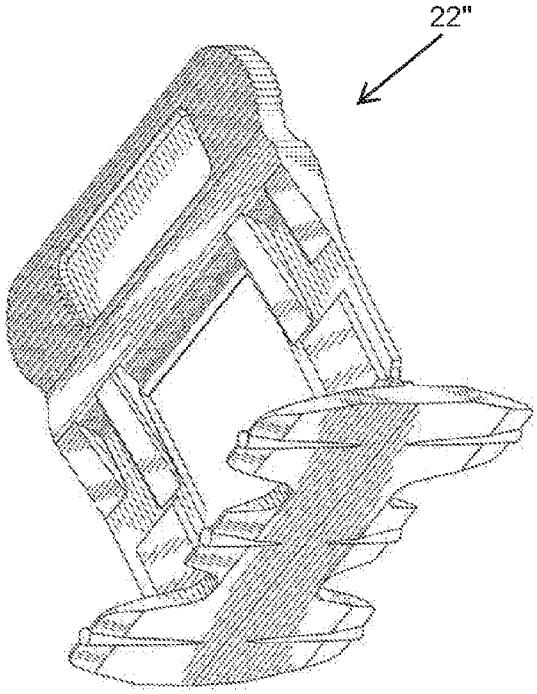
Figure 12C:
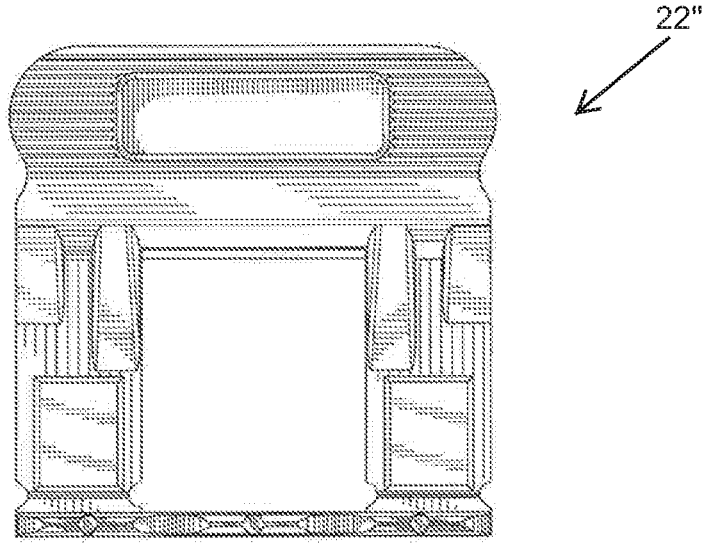
Figure 12D:
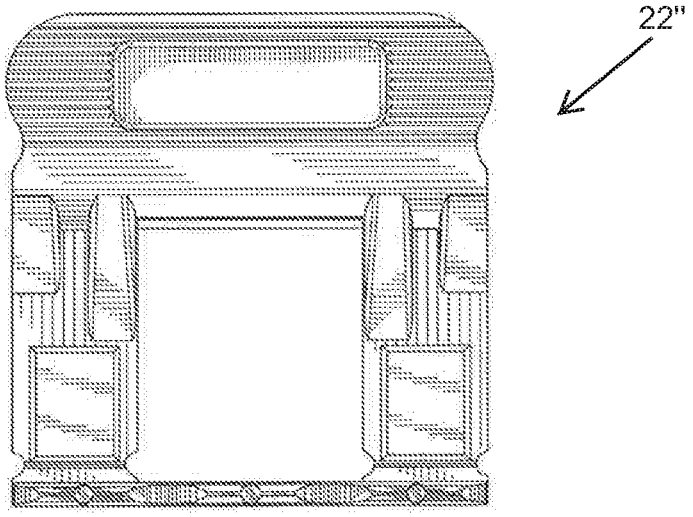
Figure 12E:
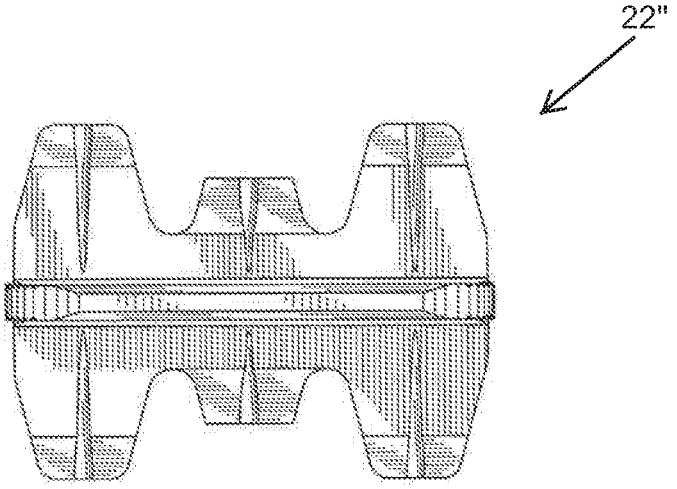
Figure 12F:
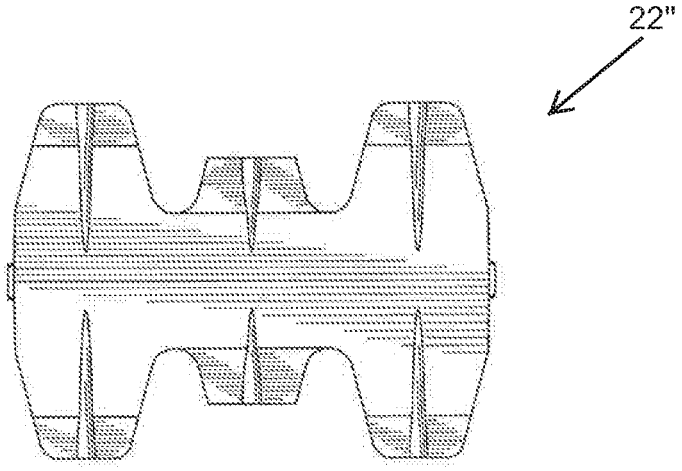
Figure 12G:
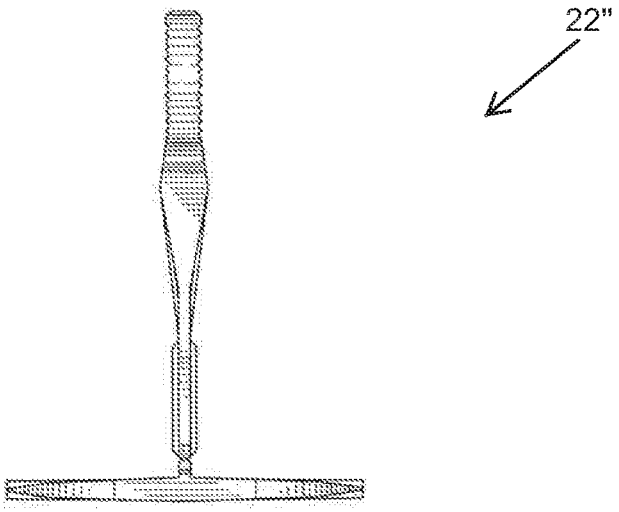
Figure 12H:
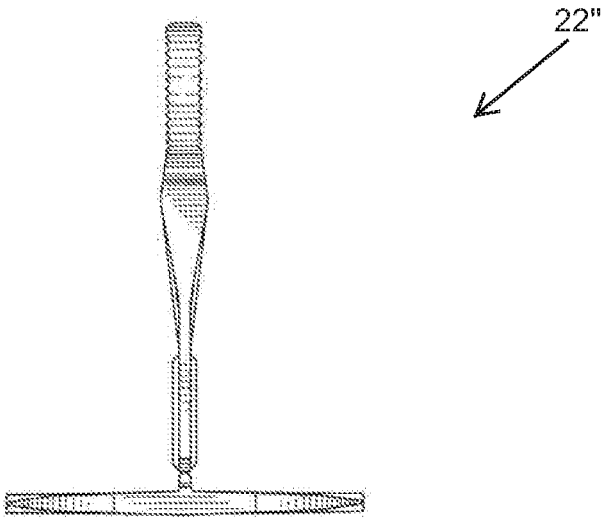
Figure 13A:
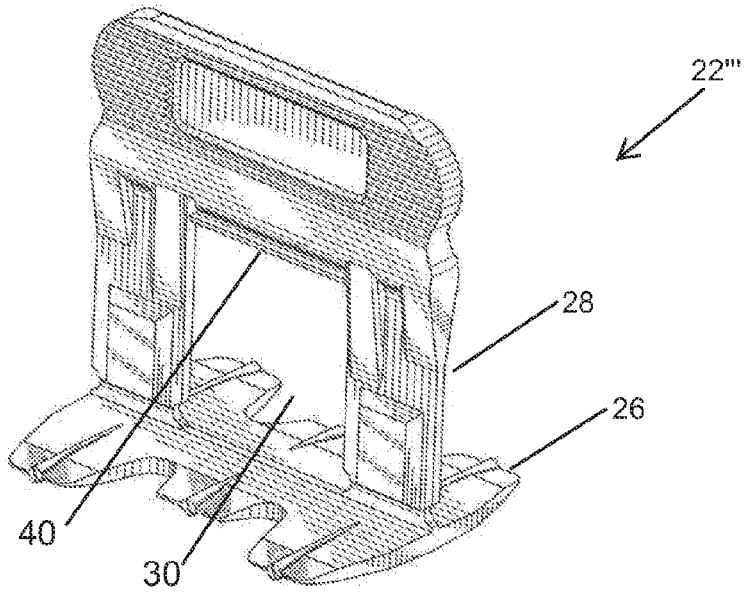
FIGS. 13A-H are views of a wedge receiver according to another embodiment.
Figure 13B:
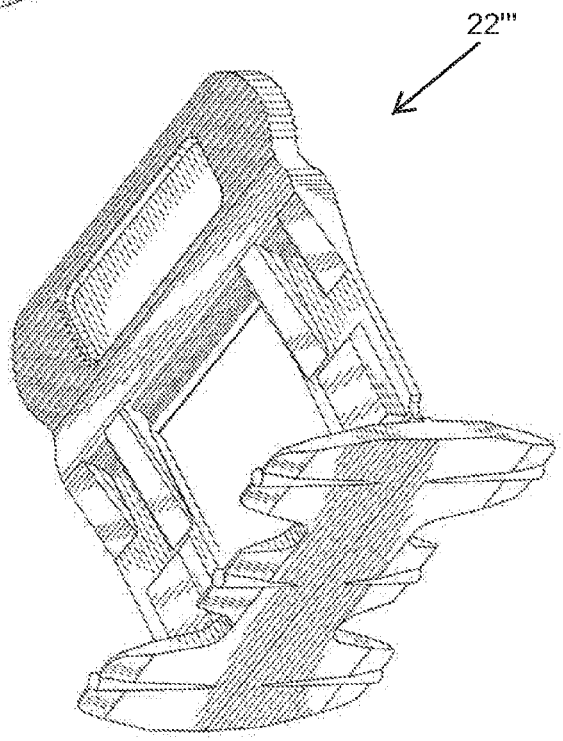
Figure 13C:
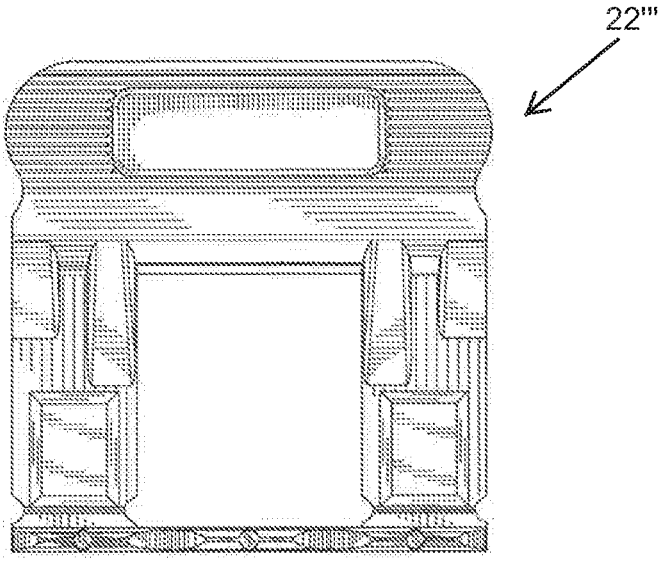
Figure 13D:
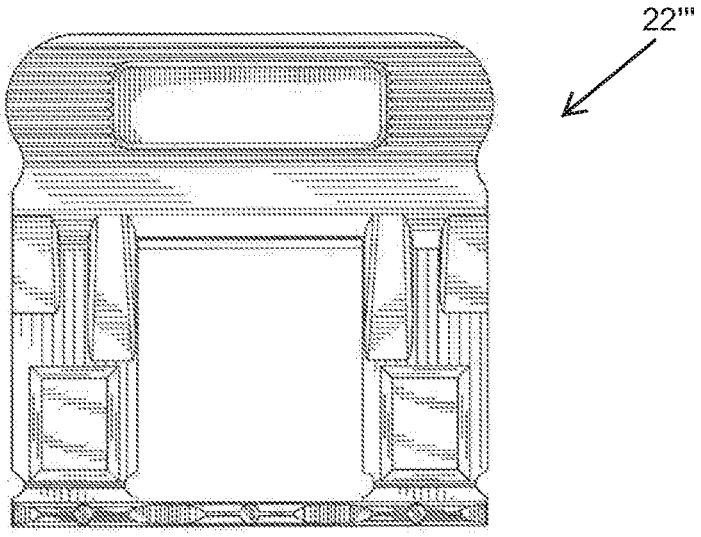
Figure 13E:
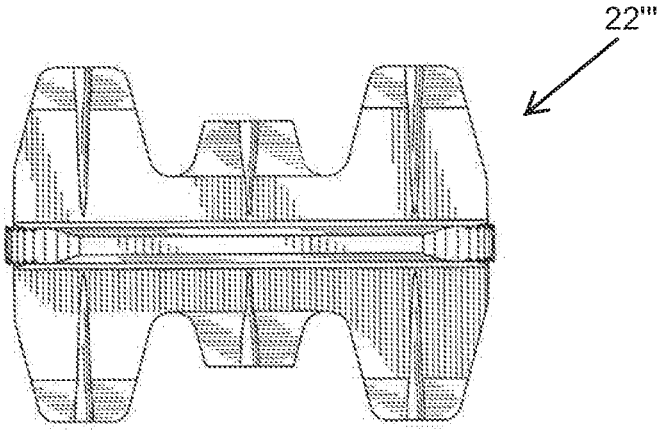
Figure 13F:
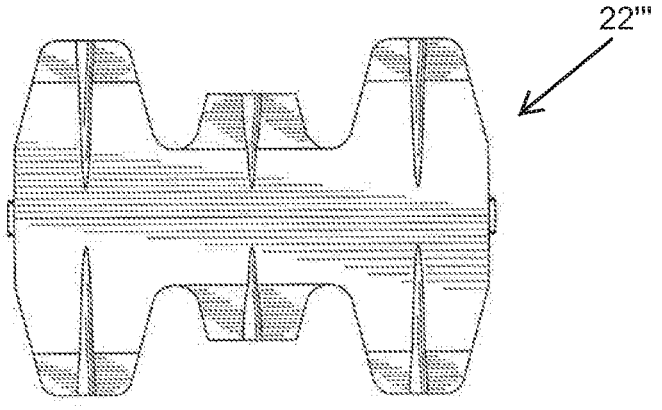
Figure 13G:
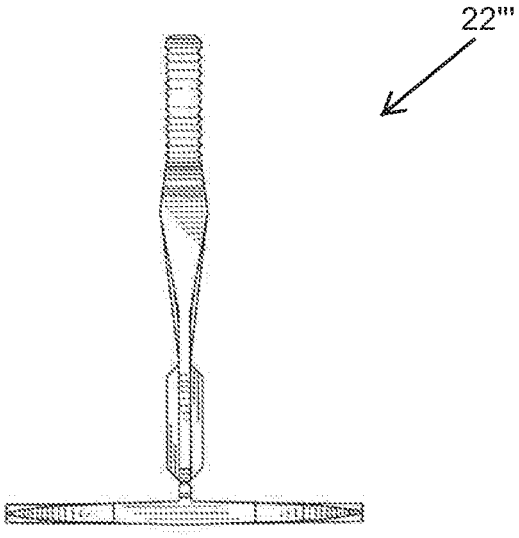
Figure 13H:
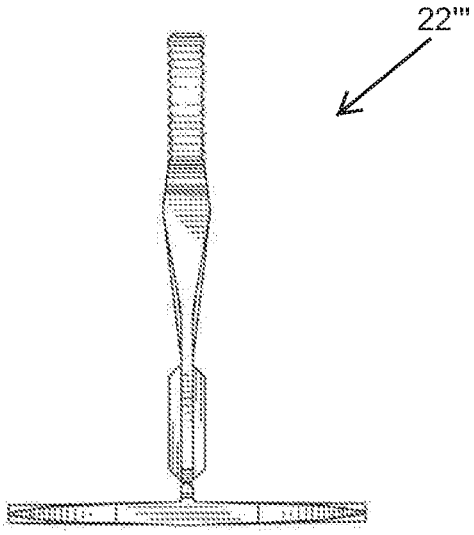
Figure 14A:
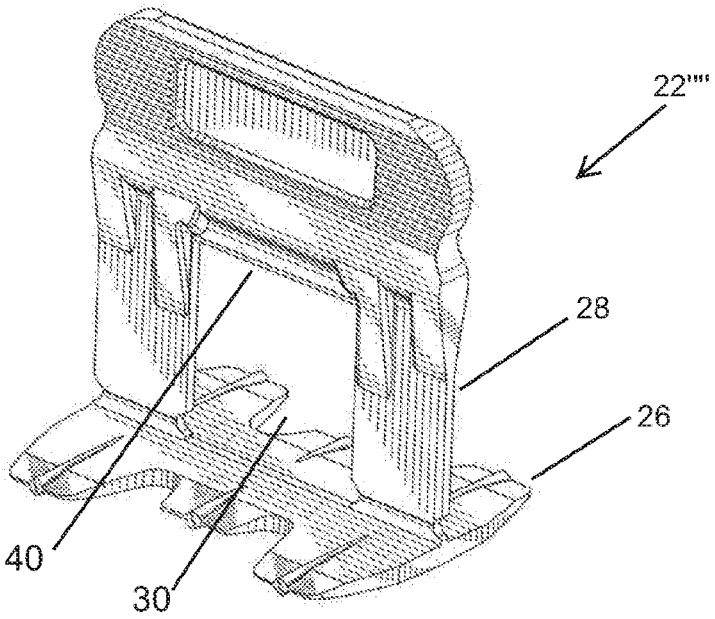
FIGS. 14A-H are views of a wedge receiver according to another embodiment.
Figure 14B:
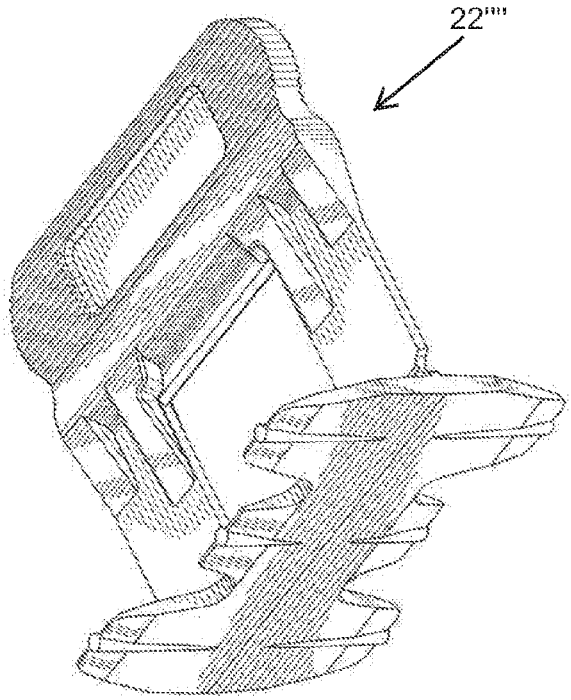
Figure 14C:
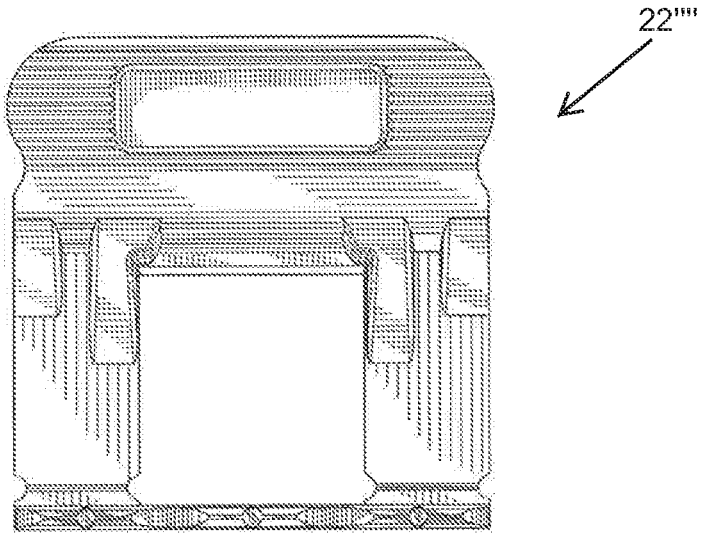
Figure 14D:
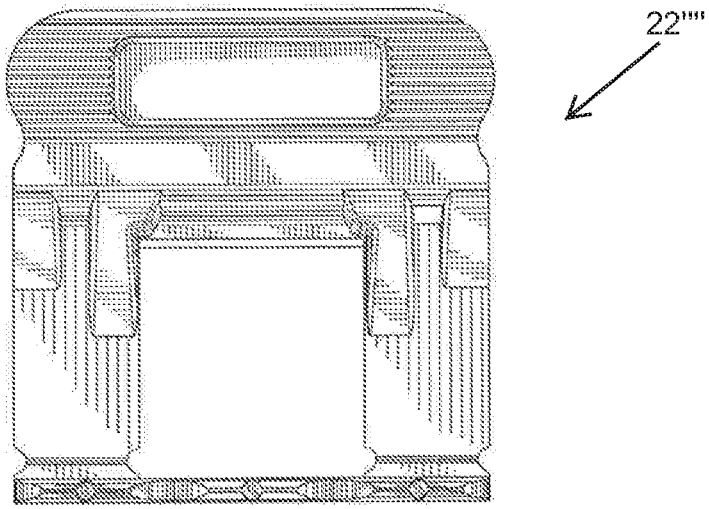
Figure 14E:
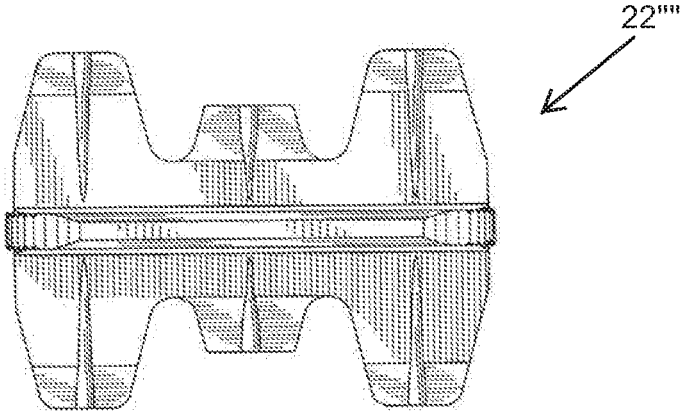
Figure 14F:
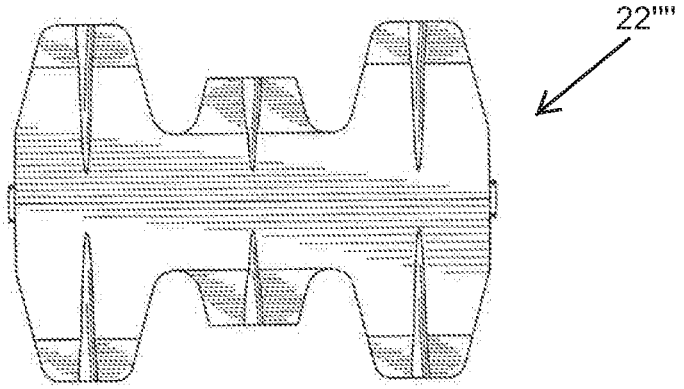
Figure 14G:
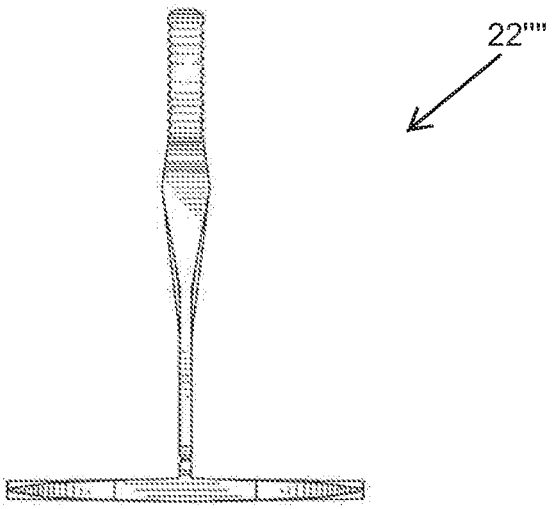
Figure 14H:
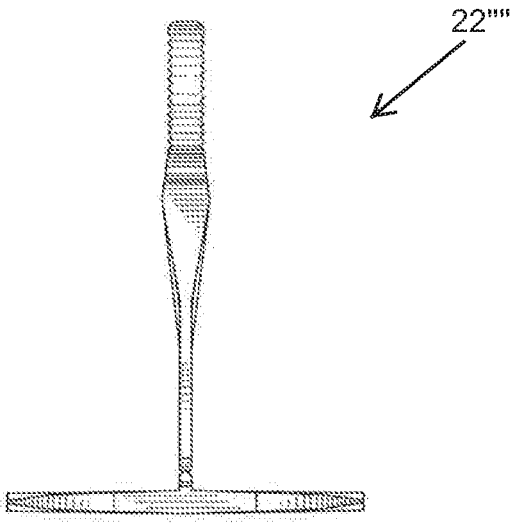
Figure 15A:
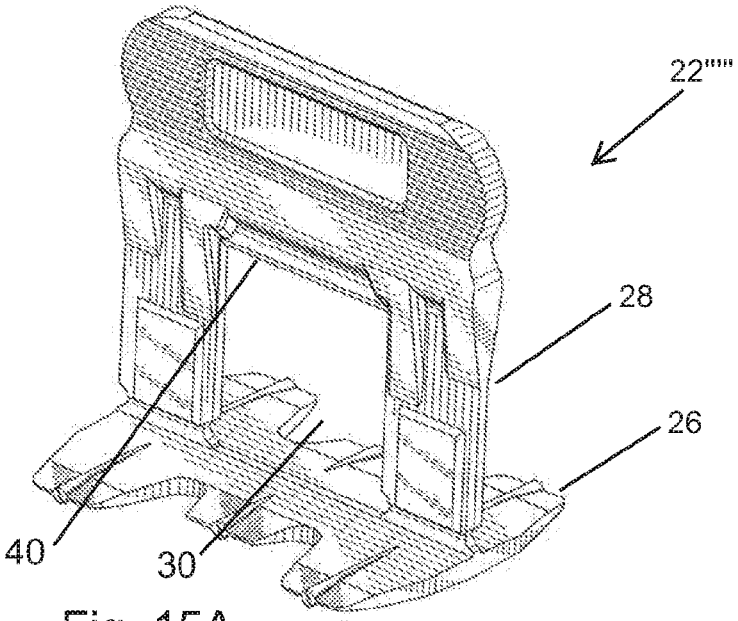
FIGS. 15A-H are views of a wedge receiver according to another embodiment.
Figure 15B:
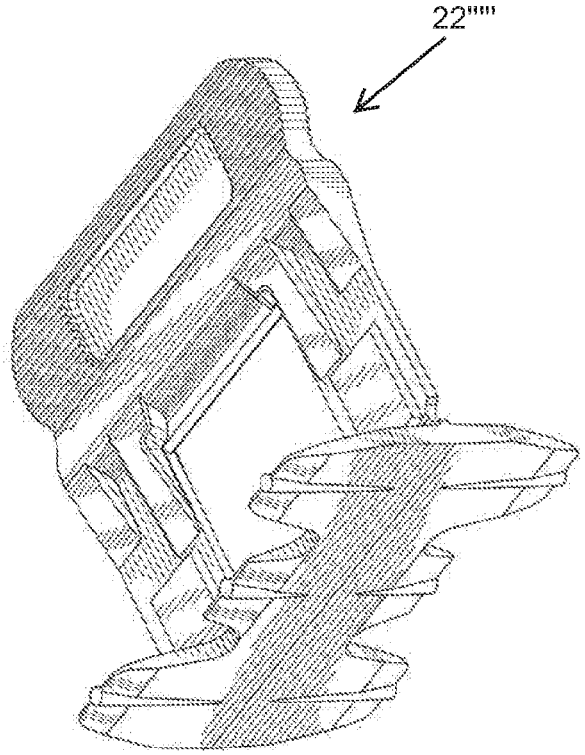
Figure 15C:
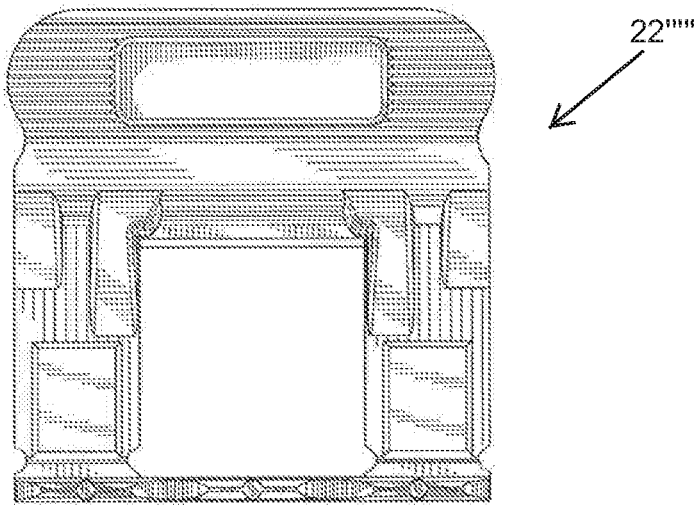
Figure 15D:
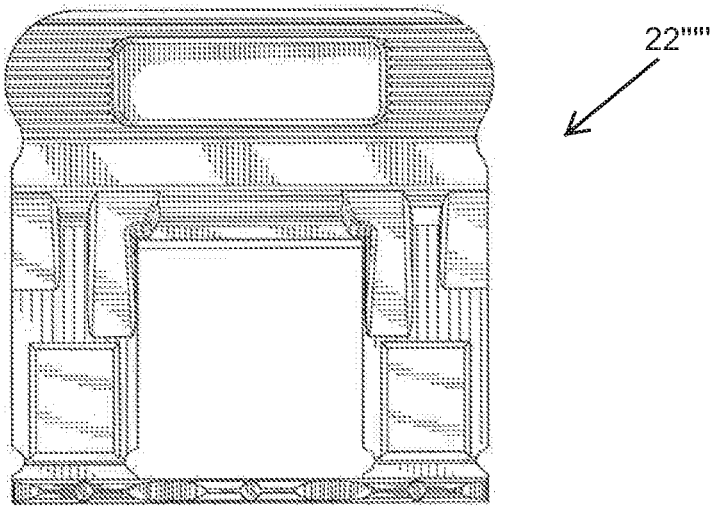
Figure 15E:
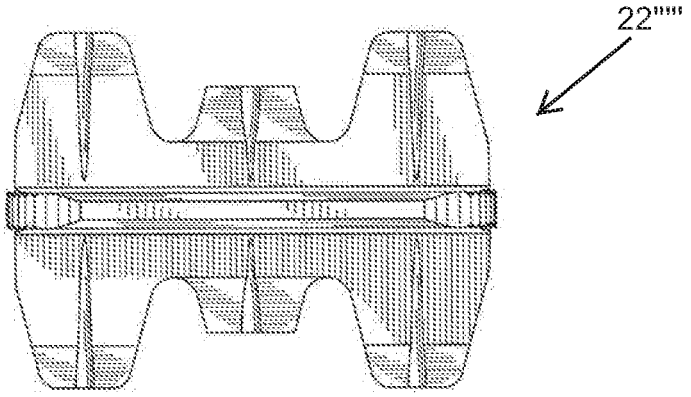
Figure 15F:
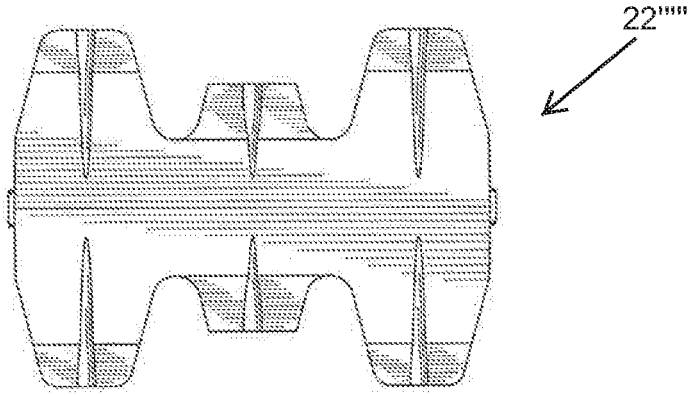
Figure 15G:
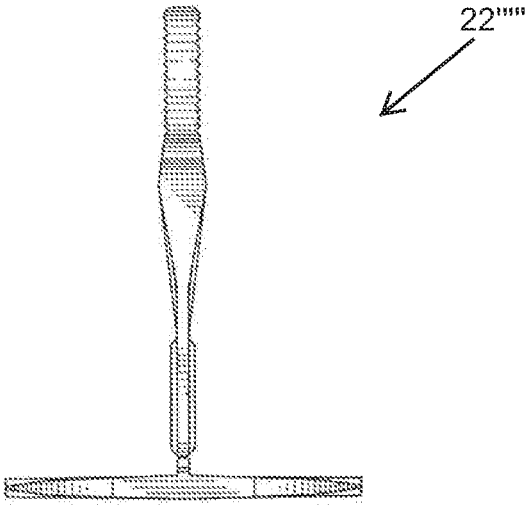
Figure 15H:
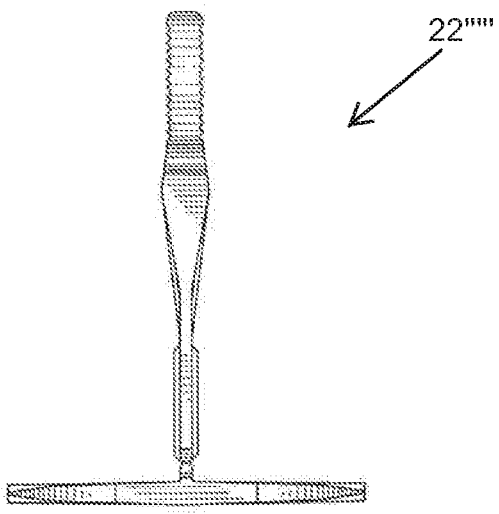
Figure 16A:
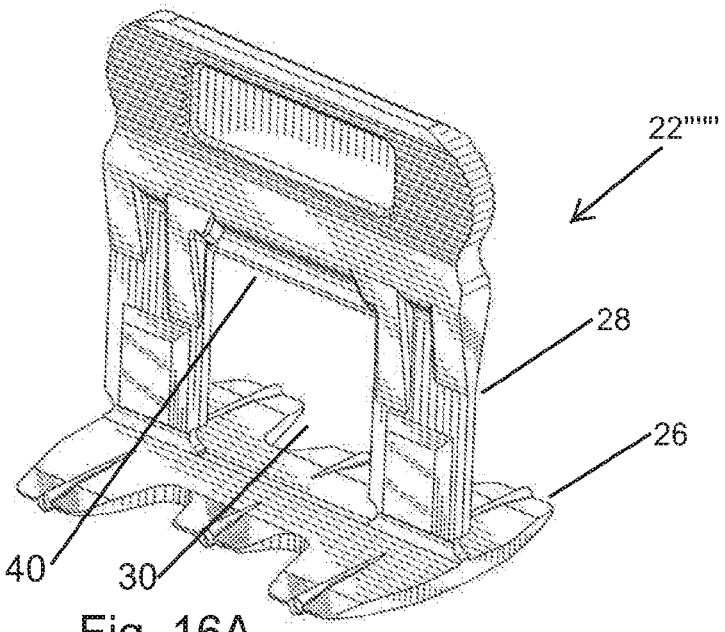
FIGS. 16A-H are views of a wedge receiver according to another embodiment.
Figure 16B:
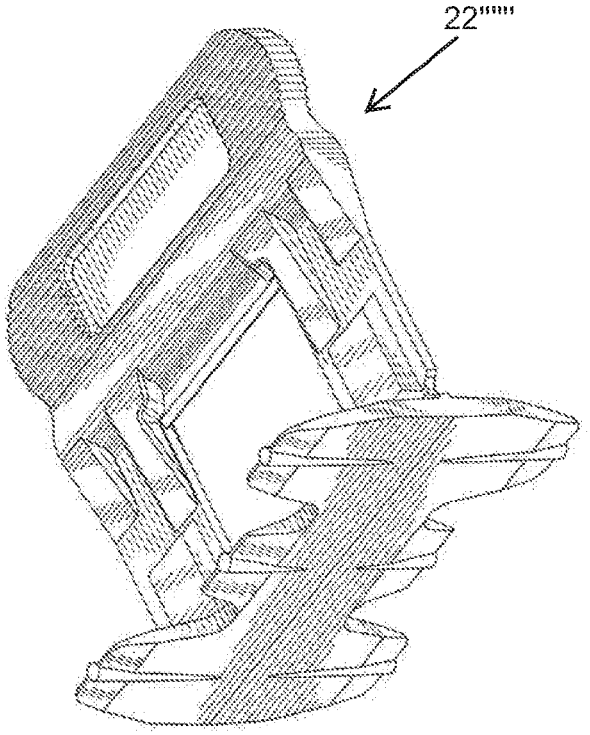
Figure 16C:
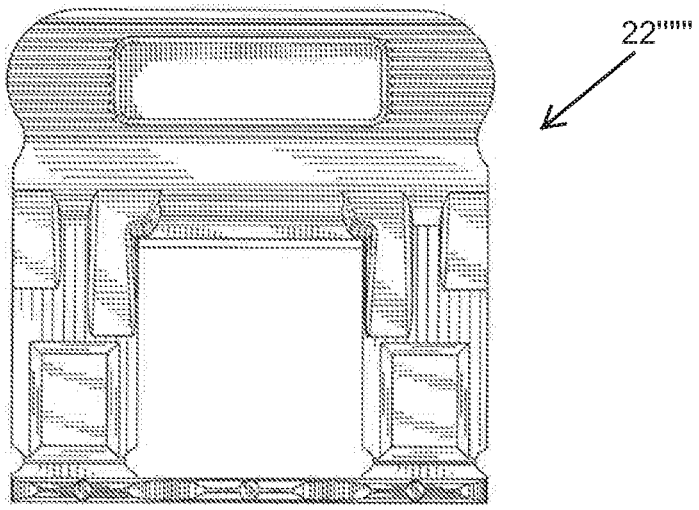
Figure 16D:
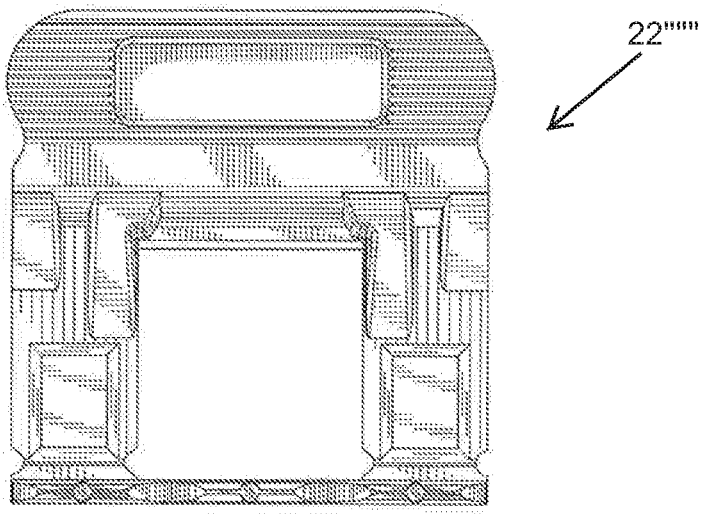
Figure 16E:
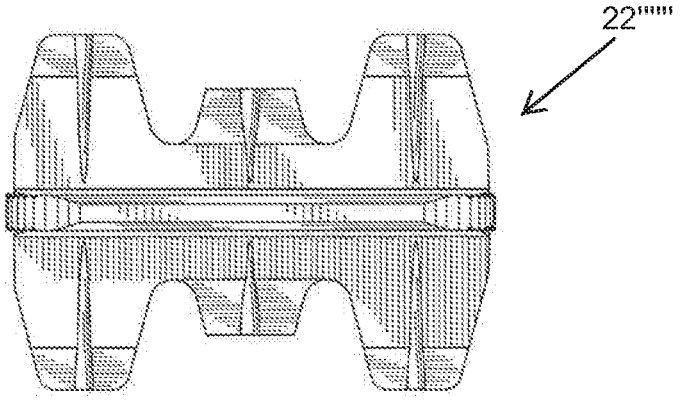
Figure 16F:
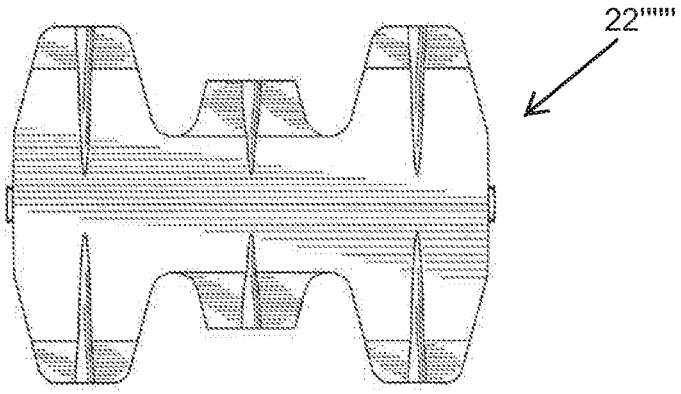
Figure 16G:
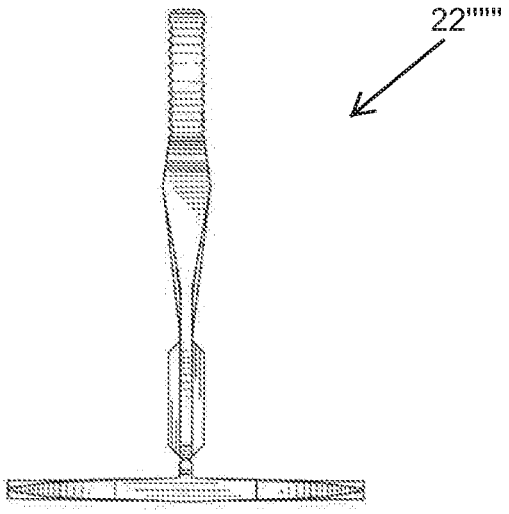
Figure 16H:
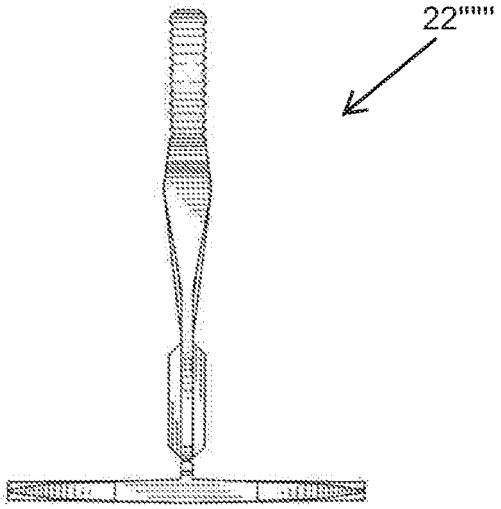
Figure 17A:
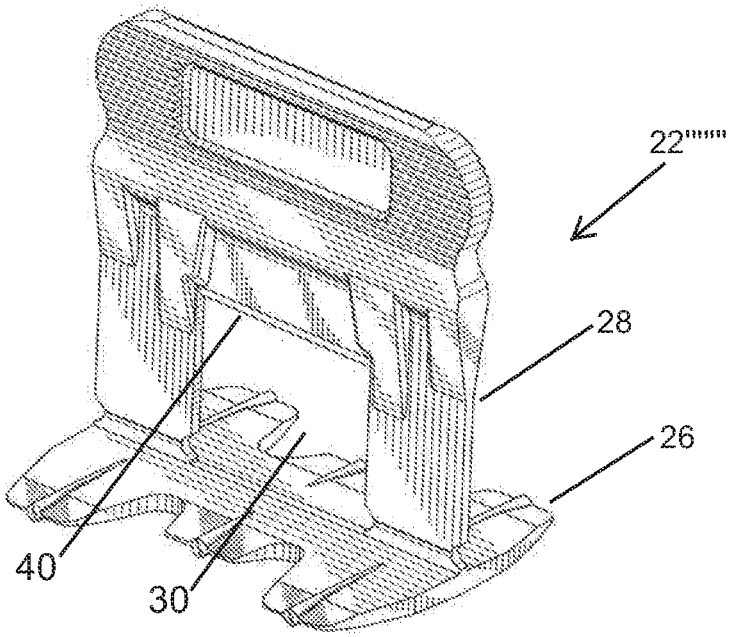
FIGS. 17A-H are views of a wedge receiver according to another embodiment.
Figure 17B:
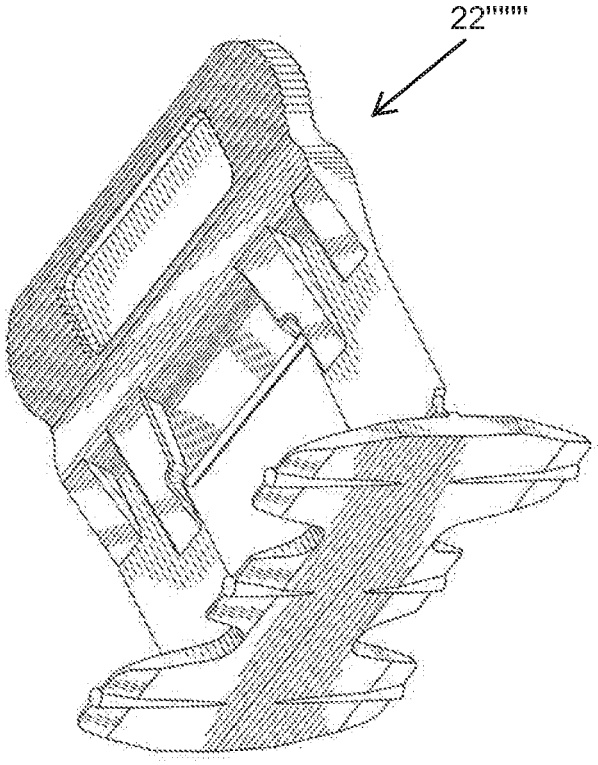
Figure 17C:
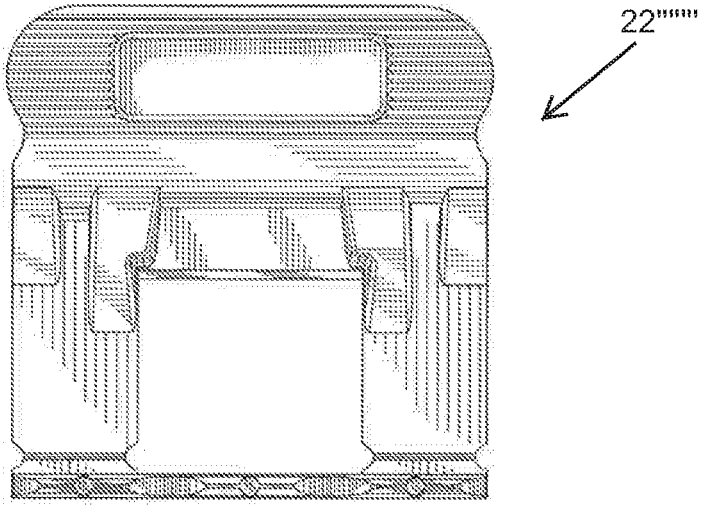
Figure 17D:
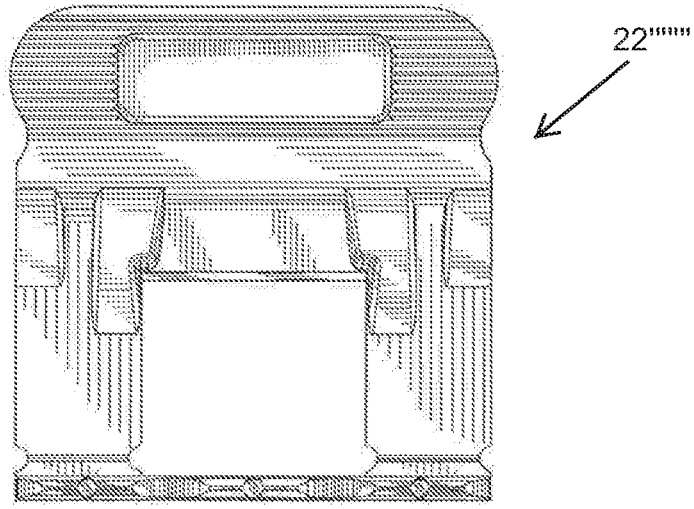
Figure 17E:
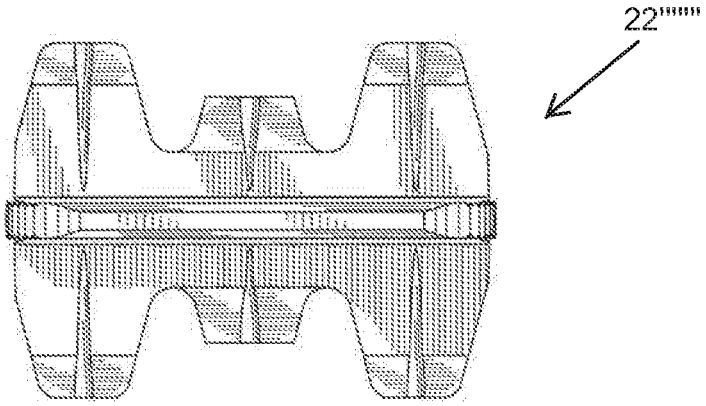
Figure 17F:
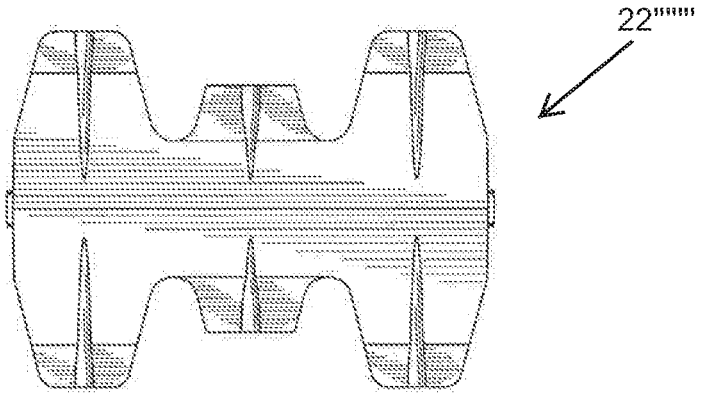
Figure 17G:
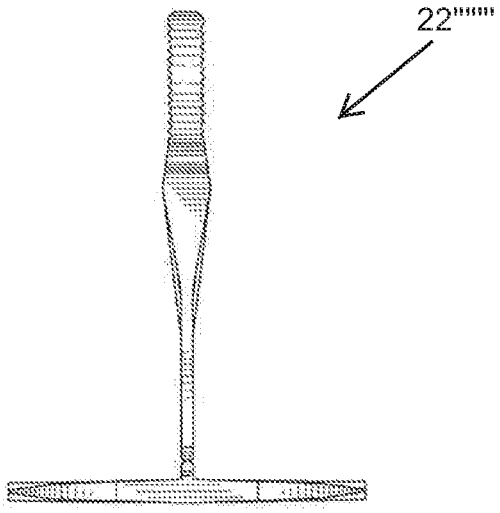
Figure 17H:
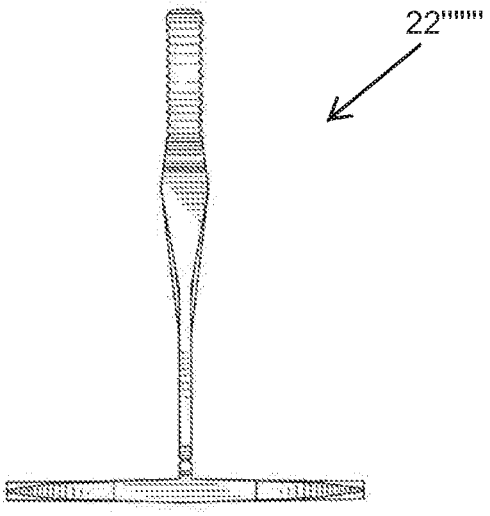
Figure 18A:
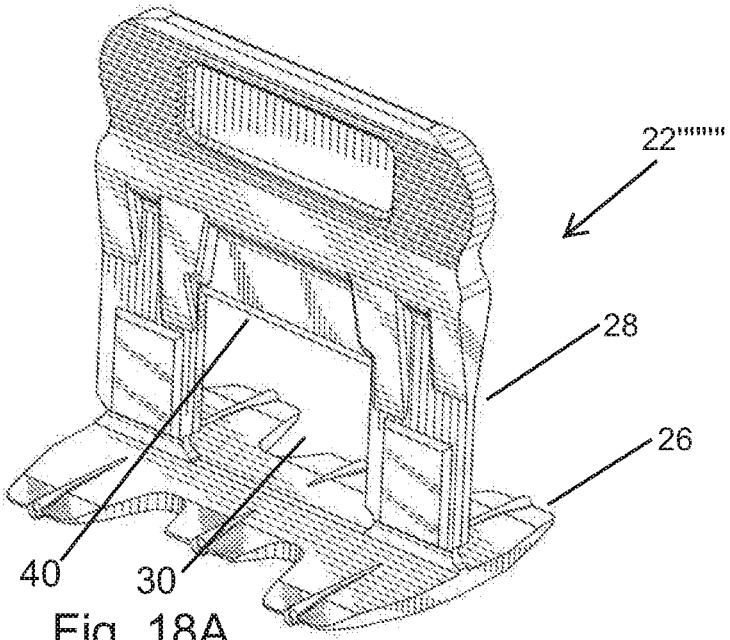
FIGS. 18A-H are views of a wedge receiver according to another embodiment.
Figure 18B:
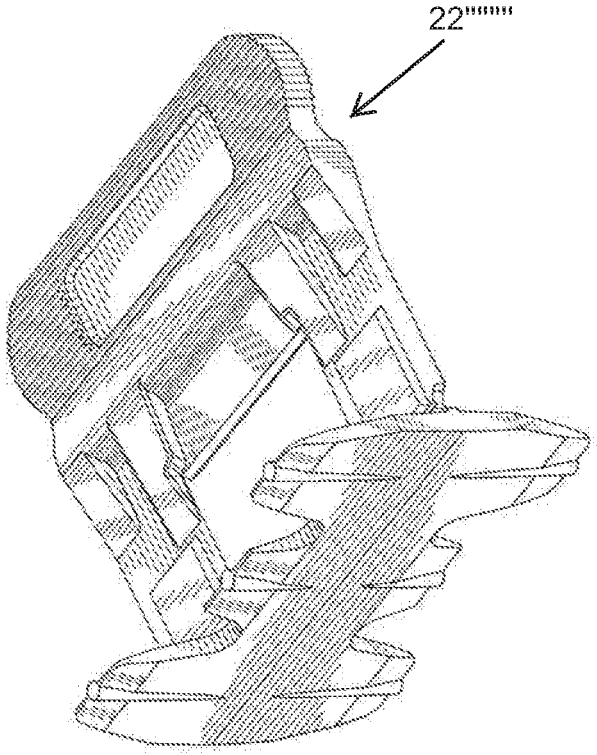
Figure 18C:
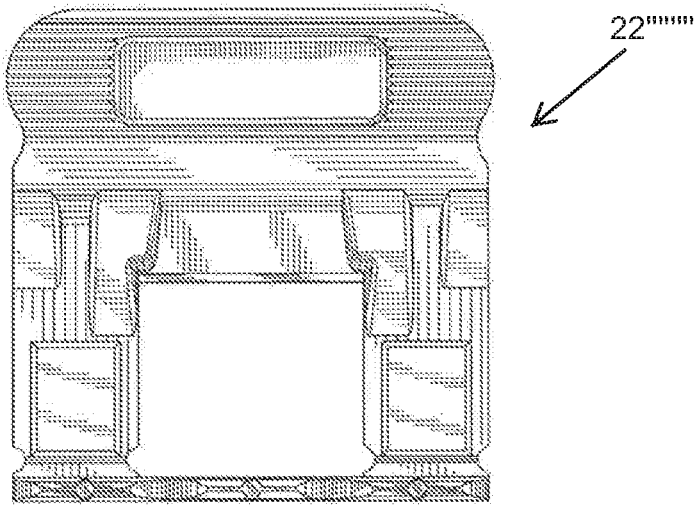
Figure 18D:
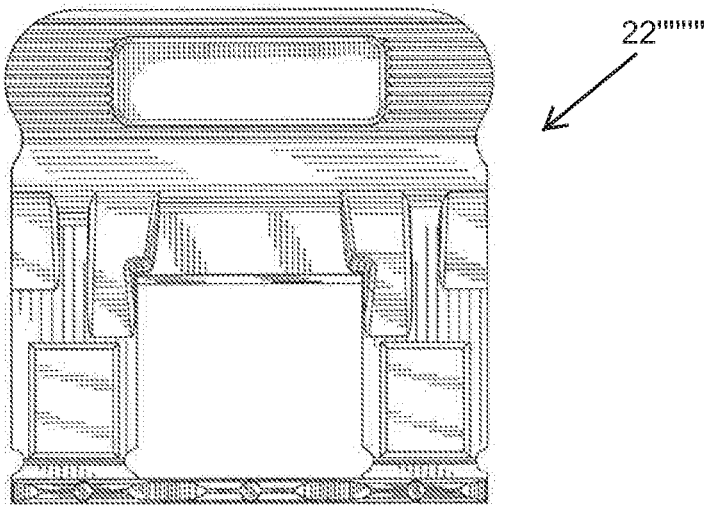
Figure 18E:
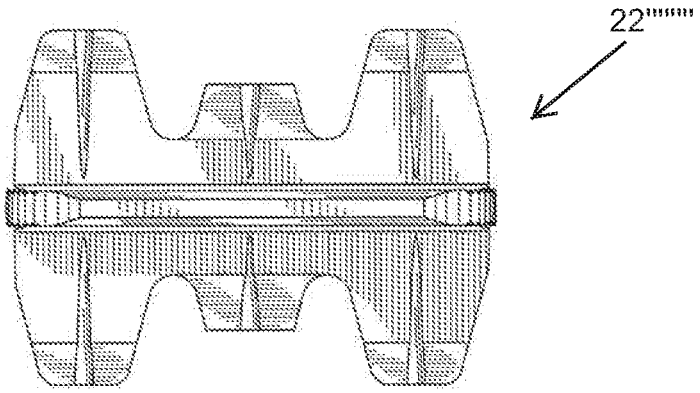
Figure 18F:
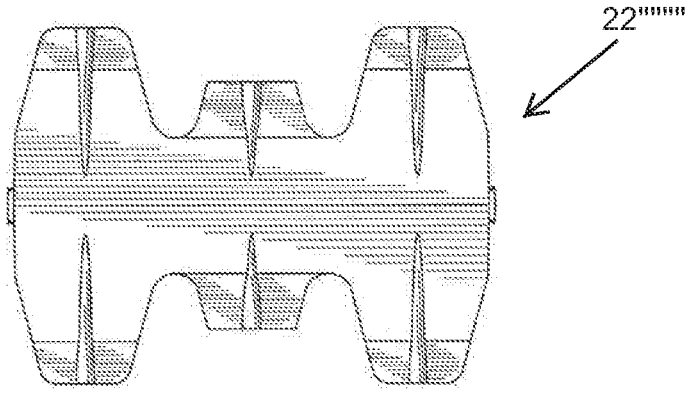
Figure 18G:
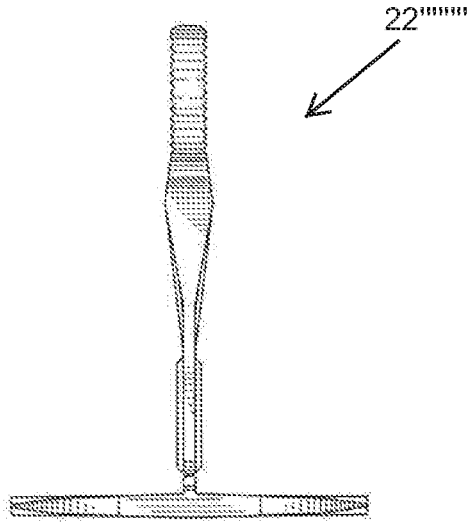
Figure 18H:
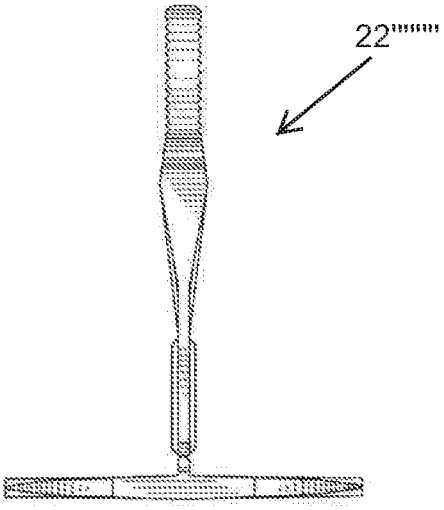
Figure 19A:
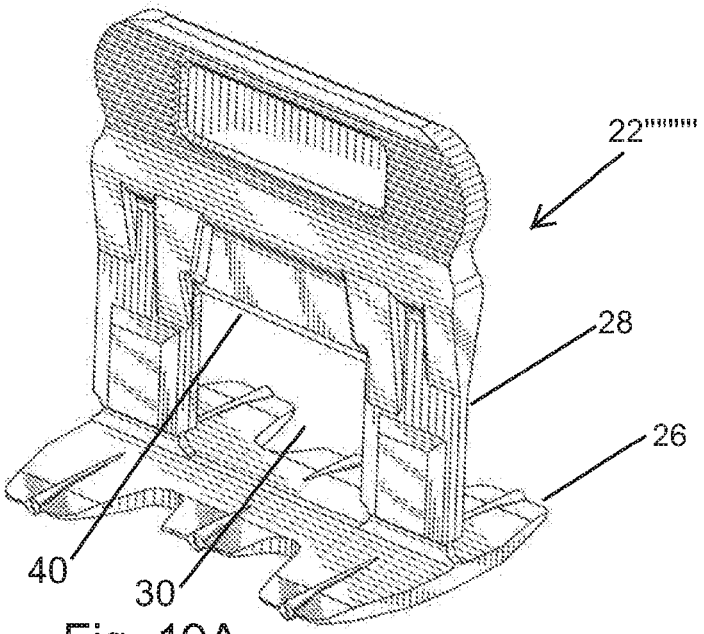
FIGS. 19A-H are views of a wedge receiver according to another embodiment.
Figure 19B:
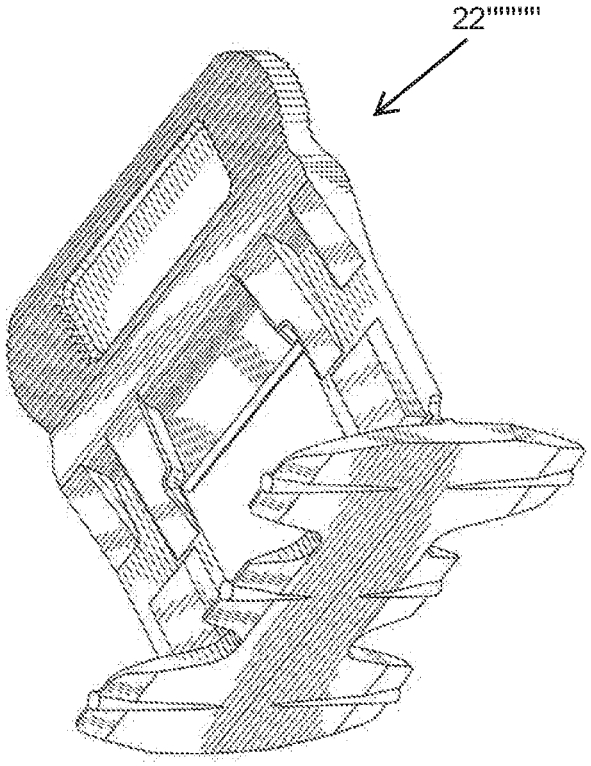
Figure 19C:
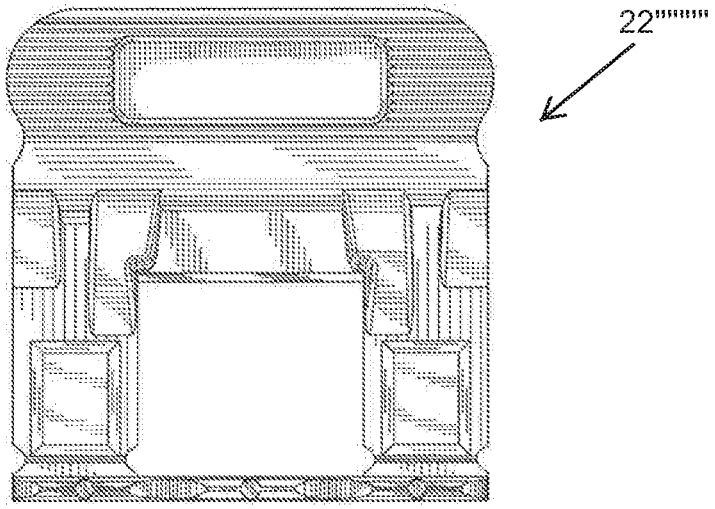
Figure 19D:
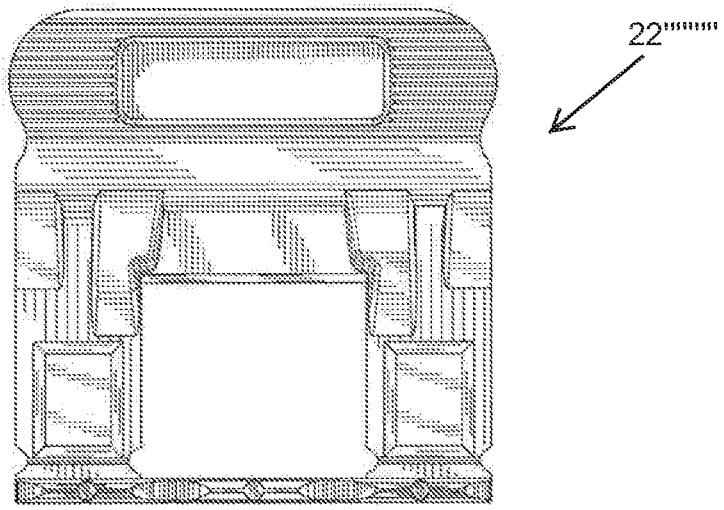
Figure 19E:
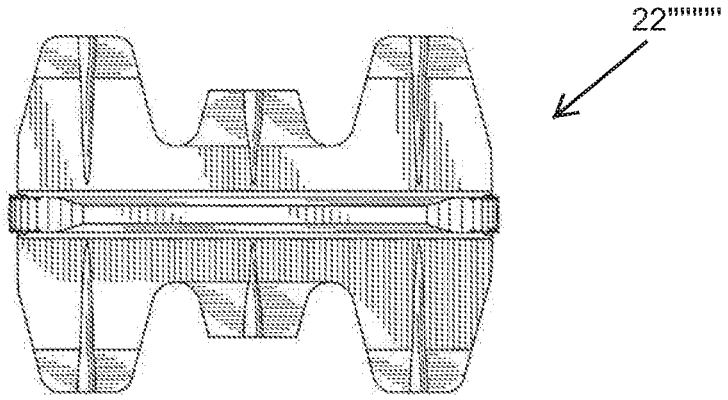
Figure 19F:
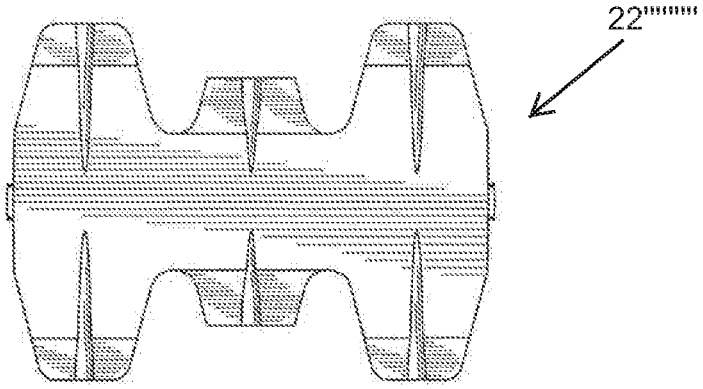
Figure 19G:
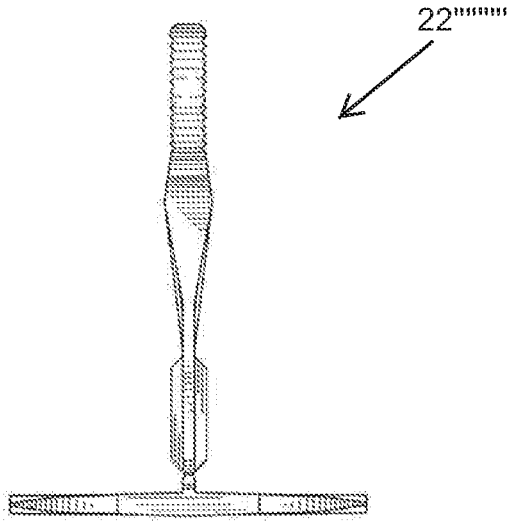
Figure 19H:
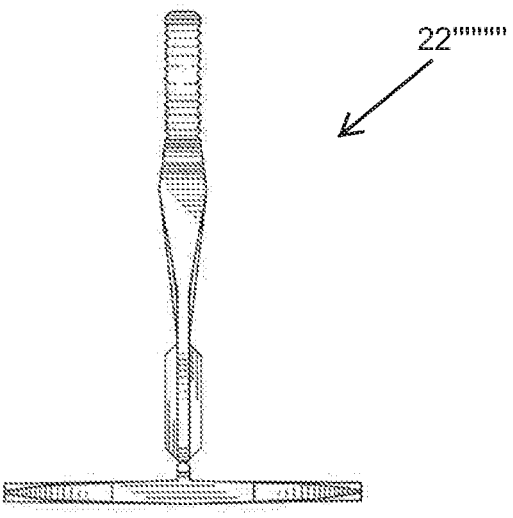

Each wedge, in use, as shown in FIGS. 6 and 8 extends through the aperture of a respective receiver such that:

- the planar surface of the wedge is positioned in abutting relation against the pair of adjacent tiles;
- the hook element is resiliently deformed, to provide for a clamped engagement of the pair of adjacent tiles between the planar surface of the wedge and the planar element, thereby to provide for said substantially coplanar relation;
- the gripping surface grips the respective wedge receiver, to resist withdrawal of the wedge from the aperture and maintain the clamped engagement until the mortar has cured.

After the mortar has cured, the wedges are removed and the hook elements are separated from the planar elements by a mallet, by virtue of the frangible connection therebetween.

Persons of ordinary skill will readily appreciate that all of the above is conventional.

The improved wedge system differs from the prior art by virtue of, inter alia, a gripping surface 34 defined by a plurality of arcuate ribs 38, by a pair of wings or lips on the wedge, opposite the edge 36, by an arcuate shape of the forcing surface 52 and by an angled relationship of the forcing surface 52 to the clamping surface of about 80°.

More specifically, the arcuate ribs 38 are shaped such that, in use, when the wedge is inserted through the aperture of a hook element and the hook element is resiliently deformed, an edge 40 of the hook element that presents towards the ribbed surface of the wedge is use, is itself arcuate and nests in a valley 42 defined between adjacent ribs 38.

The improved wedge system has been found to be relatively easy to use and relatively long-wearing when made of materials similar to those of the prior art.

Whereas prior art wedge systems often require pliers to provide for adequate engagement of the wedges, the wedges in the improved wedge system can be easily installed by hand, with the wedge and wedge receiving pinched between the thumb and forefingers, respectively, of the user. Without intending to be bound by theory, it is believed that the angle of the forcing surface 52 facilitates hand insertion of the wedge. However, the wedges can also be installed using pliers, if desired.

Further, whereas prior art wedges have a tendency to wear along the edges in use, and typically lose effectiveness after about ten uses, wedges of the present invention have proven useful for up to 100 uses. Without intending to be bound by theory, it is believed that the arcuate arrangement of the ridges provides for the above.

The wings or lips on the wedge facilitate removal of the wedge, when desired, and also increase the surface area of the forcing surface, which, without intending to be bound by theory, may facilitate hand insertion of the wedge.

Other notable areas of improvement in the wedge system shown include steps defined at the leading edge of the wedge, which can be used to clean grout lines, notches defined at the junction of the hook elements and planar elements, to define the frangible connection.

Whereas a specific embodiment is shown in FIGS. 1-10, variations are possible.

For example, FIGS. 11-19 show a number of variations of the wedge receiver adapted for use with tiles of differing thickness [the hook elements are taller or shorter, as required] and adapted to produce grout lines of differing thickness [protuberances of differing thicknesses on the hook elements are provided adjacent the notches].

FIGS. 11A-H are views of a wedge receiver 22' according to another embodiment which is useful for relatively thick tiles and provides for a 1 mm grout line.

FIGS. 12A-H are views of a wedge receiver 22" similar to that of FIGS. 11A-H which provides for a 2 mm grout line.

FIGS. 13A-H are views of a wedge receiver 22''' similar to that of FIGS. 11A-H which provides for a 3 mm grout line.

FIGS. 14A-H are views of a wedge receiver 22'''' according to another embodiment which is useful for tiles thinner than those of FIGS. 11-13 and provides for a 1 mm grout line.

FIGS. 15A-H are views of a wedge receiver 22''''' similar to that of FIGS. 14A-H which provides for a 2 mm grout line.

FIGS. 16A-H are views of a wedge receiver 22'''''' similar to that of FIGS. 14A-H which provides for a 3 mm grout line.

FIGS. 17A-H are views of a wedge receiver 22''''''' according to another embodiment which is useful for tiles thinner than those of FIGS. 14A-H and which provides for a 1 mm grout line.

FIGS. 18A-H are views of a wedge receiver 22'''''''' similar to that of FIGS. 17A-H which provides for a 2 mm grout line.

FIGS. 19A-H are views of a wedge receiver 22''''''''' similar to that of FIGS. 17A-H which provides for a 3 mm grout line.

As may be recognized by those of ordinary skill in the pertinent art based on the teachings herein, numerous changes and modifications may be made to the above-described and other embodiments of the present invention without departing from the spirit of the invention as defined in the claims. Accordingly, this detailed description of embodiments is to be taken in an illustrative, as opposed to a limiting sense, and the claimed invention should be understood as limited only by the accompanying claims, purposively construed.

What is claimed is:

1. A wedge system for use with tiles and mortar for creating a tiled surface having an array of the tiles arranged in substantially coplanar side-by-side evenly spaced relation, the wedge system comprising:

one or more wedge receivers, each wedge receiver having a planar element and a resilient hook element extending from the planar element in substantially perpendicular relation, the hook element having an aperture defined therein, each hook element being configured to provide spacing between a pair of adjacent tiles in an array of the tiles laid in mortar, thereby to provide substantially even side-by-side spacing of the tiles; and the planar element being configured to fit beneath the pair of adjacent tiles; and one or more wedges, each wedge having a planar clamping surface and a ribbed gripping surface having a plurality of substantially parallel ribs with each rib defining a concentric arc along the gripping surface, wherein the clamping surface is orientated in angular relation to the ribbed gripping surface to meet in an edge, and each wedge is configured to extend through the aperture of a respective wedge receiver such that:

the clamping surface of the wedge is positioned in abutting relation against the pair of adjacent tiles; and the hook element is resiliently deformed to engage the ribbed gripping surface, to provide for a clamped engagement of the pair of adjacent tiles between the clamping surface of the wedge and the planar element of the wedge receiver, thereby to provide for substantially coplanar relation between the adjacent tiles, and the gripping surface grips the respective wedge receiver, to resist withdrawal of the wedge from the aperture and maintain the clamped engagement until the mortar has cured.

2. The wedge system of claim 1, wherein the substantially parallel ribs of the wedge are shaped such that when the wedge is inserted through the aperture of a hook element an edge of the hook element that presents towards the ribbed surface of the wedge is resiliently deformed in a corresponding arcuate shape and nests in a valley defined between adjacent ribs of the wedge.

3. A wedge for use with tiles and mortar for creating a tiled surface having an array of the tiles arranged in substantially coplanar side-by-side evenly spaced relation, the wedge comprising:

a planar clamping surface and a ribbed gripping surface having a plurality of substantially parallel ribs with each rib defining a concentric arc along the gripping surface, wherein the clamping surface is orientated in angular relation to the ribbed gripping surface to meet in an edge, and each wedge is configured to extend through an aperture of a respective wedge receiver such that:

the planar clamping surface of the wedge is positioned in abutting relation against a pair of adjacent tiles and the ribbed gripping surface is engaged in an aperture of the wedge receiver to provide for a clamped engagement of the pair of adjacent tiles between the planar clamping surface of the wedge and a planar element of the wedge receiver, thereby to provide for substantially coplanar relation between adjacent tiles, wherein the ribbed gripping surface of the wedge grips the respective wedge receiver to resist withdrawal of the wedge from the aperture and maintain the clamped engagement until mortar underlying the adjacent tiles has cured.

4. A wedge receiver for use in a wedge system used with tiles and mortar for creating a tiled surface, the wedge receiver comprising:

a planar element and a resilient hook element extending from the planar element in substantially perpendicular relation, the hook element having an aperture defined therein and being configured to provide spacing spacer between a pair of adjacent tiles in an array of the tiles laid in mortar, thereby to provide substantially even side-by-side spacing of the tiles; and the planar element being configured to fit beneath the pair of adjacent tiles, wherein the wedge receiver is adapted to receive a wedge extending through the aperture of the hook element, the wedge having a ribbed gripping surface with substantially parallel ribs with each rib defining an arc along the gripping surface, and wherein when the wedge is inserted through the aperture of the hook element, the hook element is resiliently deformed in a corresponding arcuate shape and nests in a valley defined between adjacent ribs.

* * * * *